US007202879B2

(12) United States Patent
Murai et al.

(10) Patent No.: US 7,202,879 B2
(45) Date of Patent: Apr. 10, 2007

(54) IMAGE PROCESSING METHOD, IMAGE PROCESSING APPARATUS, ELECTRONIC DEVICE, IMAGE PROCESSING PROGRAM, AND RECORDING MEDIUM ON WHICH THE SAME PROGRAM IS RECORDED

(75) Inventors: Kiyoaki Murai, Suwa (JP); Hidekuni Moriya, Suwa (JP); Jun Takeuchi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 456 days.

(21) Appl. No.: 09/966,267

(22) Filed: Oct. 1, 2001

(65) Prior Publication Data

US 2002/0070948 A1 Jun. 13, 2002

(30) Foreign Application Priority Data

Oct. 3, 2000 (JP) ..... 2000-303744

(51) Int. Cl.
*G09G 5/10* (2006.01)

(52) U.S. Cl. ..... 345/690; 345/904

(58) Field of Classification Search ..... 345/596, 345/597, 598, 589, 87, 89, 690, 692, 694, 345/88; 358/1.9, 3.03; 382/162, 167
See application file for complete search history.

(56) References Cited

U.S. PATENT DOCUMENTS 5,201,030 A 4/1993 Carrie
5,298,915 A 3/1994 Bassetti, Jr., et al.
5,712,657 A 1/1998 Eglit et al.
5,757,298 A 5/1998 Manley et al.
6,008,794 A * 12/1999 Ishii ..... 345/598
6,069,609 A * 5/2000 Ishida et al. ..... 345/596
6,084,560 A * 7/2000 Miyamoto ..... 345/89
6,201,612 B1 * 3/2001 Matsushiro et al. ..... 358/1.9
6,288,698 B1 * 9/2001 Ishii et al. ..... 345/87
6,297,788 B1 * 10/2001 Shigeta et al. ..... 345/589
6,362,834 B2 * 3/2002 Ishii ..... 345/596
6,417,864 B1 * 7/2002 Jones et al. ..... 345/596
6,496,194 B1 * 12/2002 Mikoshiba et al. ..... 345/596

FOREIGN PATENT DOCUMENTS

EP 0 720 139 A2 7/1996
EP 0 893 916 A2 1/1999
JP A 07-064505 3/1995
JP 11-007266 A 1/1999
JP A 11-007266 1/1999
WO WO 96/36037 11/1996

* cited by examiner

*Primary Examiner*—Kent Chang
(74) *Attorney, Agent, or Firm*—Oliff & Berridge, PLC

(57) ABSTRACT

The present invention provides an image processing device that does not convert image data into a grayscale value which may cause defects in the displayed images, such as flickering or fluctuation, when performing color reduction/pseudo-halftone processing to convert the data into data which can be displayed on the color LCD panel (20). Alternatively, the frequency of occurrence of such a grayscale value can be reduced. The present invention thereby prevents a decrease in the display quality of an image output apparatus in advance by processing data supplied to the image output apparatus, such as a color LCD panel.

22 Claims, 27 Drawing Sheets

| PALETTE INDEX COLOR | ( R , G , B ) |
|---|---|
| 0 | ( 255 , 255 , 255 ) |
| 1 | ( 232, 100 , 140 ) |
| 2 | ( 221 , 255 , 30 ) |
| 3 | ( 180 , 75 , 0 ) |
| ⋮ | ⋮ |
| 252 | ( 0 , 97 , 156 ) |
| 253 | ( 0 , 30 , 170 ) |
| 254 | ( 0 , 0 , 85 ) |
| 255 | ( 0 , 0 , 0 ) |

FIG. 4

R LUT

| DXR | DXr |
|---|---|
| 0 | 0 |
| ⋮ | ⋮ |
| 104 | 96 |
| ⋮ | ⋮ |
| 120 | 128 |
| ⋮ | ⋮ |
| 255 | 255 |

FIG. 9

| | (READ)GRAYSCALE VALUE | | | | | | | |
|---|---|---|---|---|---|---|---|---|
| | 0 | 1 | 2 | 3 | 4 | 5 | 6 | 7 |
| S310 | TH01 | TH11 | TH1 | TH1 | TH1 | TH1 | TH1 | TH1 |
| S320 | TH2 | TH21 | TH22 | TH2 | TH2 | TH2 | TH2 | TH2 |
| S330 | TH3 | TH3 | TH32 | TH33 | TH3 | TH3 | TH3 | TH3 |
| S340 | TH4 | TH4 | TH4 | TH43 | TH44 | TH4 | TH4 | TH4 |
| S350 | TH5 | TH5 | TH5 | TH5 | TH54 | TH55 | TH5 | TH5 |
| S360 | TH6 | TH6 | TH6 | TH6 | TH6 | TH65 | TH66 | TH67 |

FIG. 14

<DITHER MATRIX:Dither(i,j)>

| | 0TH COLUMN | FIRST COLUMN | SECOND COLUMN | THIRD COLUMN |
|---|---|---|---|---|
| 0TH LOW | −8 | 0 | −6 | +2 |
| FIRST LOW | +4 | −4 | +6 | −2 |
| SECOND LOW | −5 | +3 | −7 | +1 |
| THIRD LOW | +7 | −1 | +5 | −3 |

(DECIMAL NOTATION)

FIG. 17

<DITHER MATRIX:Dither2(i,j)>

| | 0TH COLUMN | FIRST COLUMN | SECOND COLUMN | THIRD COLUMN |
|---|---|---|---|---|
| 0TH LOW | −8 | +8 | −4 | +12 |
| FIRST LOW | +16 | 0 | +20 | +4 |
| SECOND LOW | −2 | +14 | −6 | +10 |
| THIRD LOW | +22 | +6 | +18 | −2 |

(DECIMAL NOTATION)

FIG. 20

| INPUT | PRE-PROCESSING | DITHER PROCESSING | POST-PROCESSING |
|---|---|---|---|
| ⋮ | ⋮ | ⋮ | ⋮ |
| N−16 | N−16 | n−1 | n−1 |
| ⋮ | ⋮ | ⋮ | ⋮ |
| N | $\frac{(N-16)+N}{2}$ | n−1,n | n−1,n+1 |
| ⋮ | ⋮ | ⋮ | ⋮ |
| N+16 | N | n | n+1 |
| ⋮ | ⋮ | ⋮ | ⋮ |

<POST-PROCESSING : LUT>

| INPUT : Dout'(x,y) | OUTPUT : Dout(x,y) |
|---|---|
| 0 | 0 |
| 1 | 1 |
| 2 | 2 |
| 3 | 3 |
| 4 | 4 |
| 5 | 6 |
| 6 | 7 |
| 7 | 8 |
| 8 | 9 |
| 9 | 10 |
| 10 | 11 |
| 11 | 12 |
| 12 | 13 |
| 13 | 14 |
| 14 | 15 |
| (15) | 15 |

FIG. 26

<POST-PROCESSING : LUT>

| INPUT | OUTPUT | | |
|---|---|---|---|
| | S3 | T2 | S4 |
| ⋮ | ⋮ | ⋮ | ⋮ |
| n−2 | n−2 | n−2 | n−2 |
| n−1 | n−1 | n−1 | n |
| n | n | n+1 | n+1 |
| n+1 | n+2 | n+2 | n+2 |
| ⋮ | ⋮ | ⋮ | ⋮ |

FIG. 29

<POST-PROCESSING : LUT>

| INPUT : Dout'(x,y) | OUTPUT : Dout(x,y) |
|---|---|
| 0 | 0 |
| 1 | 1 |
| 2 | 2 |
| 3 | 3 |
| 4 | 4 |
| 5 | 6 |
| 6 | 7 |
| 7 | 8 |
| 8 | 9 |
| 9 | 10 |
| 10 | 12 |
| 11 | 13 |
| 12 | 14 |
| 13 | 15 |
| (14) | 15 |
| (15) | 15 |

FIG. 31

IMAGE PROCESSING METHOD, IMAGE PROCESSING APPARATUS, ELECTRONIC DEVICE, IMAGE PROCESSING PROGRAM, AND RECORDING MEDIUM ON WHICH THE SAME PROGRAM IS RECORDED

BACKGROUND OF THE INVENTION

1. Field of Invention

The present invention relates to image processing methods and an image processing apparatus that processes data to be output to an image output apparatus, such as a liquid crystal display panel, an electronic device provided with the image output apparatus, an image processing program for the above-described image processing, and a recording medium on which the program is recorded.

2. Description of Related Art

Generally, a monochromatic or color liquid crystal display (LCD) panel is used for an image display unit of, for example, a cellular telephone or a portable information terminal. On this LCD panel, when a driving voltage which is preset according to the grayscale value of grayscale data is applied to each of the pixels arranged in a matrix, the transmittance or the reflectance of the liquid crystal is changed in a stepwise manner. Accordingly, by controlling the voltage applied to each pixel, a desired multi-level image is output and displayed.

For the grayscale control for the LCD panel, a frame rate driving method (also referred to as the "frame rate control driving method") may be employed. In this frame rate driving method, by distributing a halftone grayscale which can be implemented over a plurality of frames in time dimension, halftone grayscale which would not be implemented in one frame can be implemented in one frame. According to this technique, the number of levels which can be represented on the LCD panel (in view of the above-described plurality of frames) is substantially increased.

According to this frame rate driving method, however, various factors, such as the frame frequency, the grayscale value of the grayscale data, the inverter frequency of an auxiliary light source (such as backlight), etc., may cause defects in displayed images which can lower the quality of a displayed image. These defects can include the so-called flickering or fluctuation.

SUMMARY OF THE INVENTION

The present invention has been made to solve the above-described problems, and an object of the present invention is to provide a technique for improving the quality of the images to be output by processing data to be output to an image output apparatus, such as a liquid crystal display panel.

In order to achieve the above object, a first image processing method according to the present invention can be characterized in that data indicating a grayscale of a pixel is input and the input data is converted into grayscale data which specifies a grayscale of an image output apparatus according to predetermined characteristics. When the input data corresponds to a specific grayscale value which may cause a defect in an output of the image output apparatus, the whole or at least part of the input data is converted into grayscale data which specifies a grayscale value other than the specific grayscale value, and the converted grayscale data is supplied to the image output apparatus. According to this method, the grayscale which may cause a defect, such as flickering or fluctuation, is not used or is reduced in the image output apparatus. As a result, the image quality can be improved.

In this method, the above-described conversion may accompany color reduction processing for reducing the number of levels which can be indicated by the input data into the number of levels which can be indicated by the grayscale data. The above-described conversion may be separately performed before or after the color reduction processing. However, it is more advantageous that the conversion is performed with the color reduction processing in light of the efficiency or the processing speed.

Additionally, if the color reduction processing is accompanied in performing the above-described conversion, the color reduction processing may be pseudo-halftone processing for distributing the grayscale data so that the grayscale data does not concentrate on the same value. As the pseudo-halftone processing, various techniques, such as a dithering technique or an error diffusion technique for distributing an error occurring during the conversion to the peripheral pixels may be applicable.

In this case, the color reduction processing may preferably convert all the input data corresponding to the specific grayscale value into grayscale data which specifies one of grayscale values adjacent to the specific grayscale value. In such conversion, the grayscale which may cause a defect in the displaying image is completely eliminated in the image output apparatus, which is thus useful in light of an improvement in the image quality.

In order to achieve the above-described object, a second image processing method according to the present invention can be characterized by including a step of inputting data which indicates a grayscale of a pixel and a step of converting the input data into grayscale data which specifies a grayscale of an image output apparatus by reducing the number of levels of the input data according to predetermined characteristics. Further, by performing pseudo-halftone processing for displaying a halftone, in which, when the input data corresponds to a specific grayscale value which may cause a defect in an output of the image output apparatus, the whole or at least part of the input data is converted into grayscale data which specifies one of grayscale values adjacent to the specific grayscale value, and of supplying the converted data to the image output apparatus.

According to this method, the input data is reduced to the number of levels which can be output by the image output apparatus. Also, since the grayscale which may cause a defect, such as flickering or fluctuation, is not used or is reduced in the image output apparatus, the image quality can be improved.

This method may be divided into two types, i.e., a first mode in which, after the pseudo-halftone processing, it is determined whether the processed data is a specific grayscale value, and a second mode in which it is determined in advance whether the data is to be converted into a specific grayscale value if the pseudo-halftone processing is performed on the data. This method may further divided into two types, i.e., a third mode in which the specific grayscale value which may cause a defect in the displayed image is completely eliminated, and a fourth mode in which part of the grayscale value is allowed. Accordingly, if the above-described modes are combined, a total of four types of modes are considered, and these types of modes will be sequentially discussed.

In the above-described method, the step of converting the input data into the grayscale data may further include a step of performing first pseudo-halftone processing on the input data, a step of determining whether the data subjected to the first pseudo-halftone processing is the specific grayscale value, and a step of outputting the data subjected to the first pseudo-halftone processing as the grayscale data when a result of the determination step is no, and of further performing second pseudo-halftone processing on the data subjected to the first pseudo-halftone processing when a result of the determination step is yes so as to convert the data into the grayscale data which specifies one of the grayscale values adjacent to the specific grayscale value. This mode corresponds to a combination of the above-described first and third modes. According to this combination, the grayscale which causes a defect in the displayed image is expressed as a pseudo-value by the adjacent grayscale, and thus, a halftone can be smoothly output while improving the image quality.

In the above-described method, the step of converting the input data into the grayscale data may further include a step of performing first pseudo-halftone processing on the input data, a step of determining whether the data subjected to the first pseudo-halftone processing is the specific grayscale value and whether the input data is contained in part of a range corresponding to the specific grayscale value in the above-described characteristics, and a step of outputting the data subjected to the first pseudo-halftone processing as the grayscale data while allowing an output of the specific grayscale value when a result of the determination step is no, and of further performing second pseudo-halftone processing on the data subjected to the first pseudo-halftone processing when a result of the determination step is yes so as to convert the data into the grayscale data which specifies one of the grayscale values adjacent to the specific grayscale value. This mode corresponds to a combination of the above-described first and fourth modes. According to this combination, although part of the grayscale which causes a defect in the displayed image is output, the other elements of the grayscale can be expressed as pseudo-values by the adjacent grayscales, and thus, a halftone can be output more smoothly. The term "allow" can mean that the grayscale which may cause a defect in the displayed image is partially used instead of completely eliminating such a grayscale.

In the above-described method, the step of converting the input data into the grayscale data may further include a step of determining whether the input data is contained in a range which is to be converted into the specific grayscale value after performing first pseudo-halftone processing, and a step of performing the first pseudo-halftone processing on the input data when a result of the determination step is no so as to convert the data into the grayscale data, and of performing second pseudo-halftone processing on the input data when a result of the determination step is yes so as to convert the data into the grayscale data which specifies one of the grayscale values adjacent to the specific grayscale value. This mode corresponds to a combination of the above-described second and third modes. According to this mode, the grayscale which causes a defect in the displayed image is expressed as a pseudo-value by the adjacent grayscale, and thus, a halftone can be smoothly output while improving the image quality.

In the above-described method, the step of converting the input data into the grayscale data may further include a step of determining whether the input data is contained in part of a range which is to be converted into the specific grayscale value after performing first pseudo-halftone processing and a step of performing the first pseudo-halftone processing on the input data when a result of the determination step is no so as to output the data as the grayscale data while allowing an output of the specific grayscale value, and of performing second pseudo-halftone processing on the input data when a result of the determination step is yes so as to convert the data into the grayscale data which specifies one of the grayscale values adjacent to the specific grayscale value. This mode corresponds to the above-described second and fourth modes. According to this mode, although part of the grayscale which causes a defect in the displayed image is output, the other elements of the grayscale can be expressed as pseudo-values by the adjacent grayscale, and thus, a halftone can be more smoothly output.

Further, the above-described method may be implemented by a mode which is accompanied by two stages of conversion. More specifically, in this method, the step of converting the input data into the grayscale data may include a step of converting the input data by modifying the above-described characteristics in such a manner that one of the characteristics out of the range corresponding to the special grayscale value remains the same, and the inclination of the range is substantially halved, and the other characteristic out of the range maintains the continuity, a step of performing pseudo-halftone processing on the data converted by the modified characteristics, and a step of, among the data subjected to the pseudo-halftone processing, outputting the data smaller than the special grayscale value as the grayscale data, and of shifting each grayscale value of the data greater than or equal to the special grayscale value. According to this mode, only one type of pseudo-halftone processing is required in comparison with the above-described four combinations of modes, and the conversion content is simpler, and thus, faster processing can be expected.

In order to achieve the above-described object, a third image processing method of the present invention can be characterized in that data indicating a grayscale of a pixel is input, and a dither value according to coordinates of the pixel is selected from a predetermined dither matrix for pseudo-halftone processing, and is added to the input data. The data obtained by adding the dither value thereto is reduced to the number of levels which can be indicated by an image output apparatus and it is determined whether the reduced data is a specific grayscale value which causes a defect in an output of the image output apparatus. The reduced data is output as it is to the image output apparatus when a result of the determination is no, and when a result of the determination is yes, the dither value and a value according to the color reduction are added to the reduced data so as to convert the input data into data which specifies one of grayscale values adjacent to the specific grayscale value according to the addition result and the resulting data is output to the image output apparatus.

According to this method, a grayscale which may cause a defect, such as flickering or fluctuation, is not used in the image output apparatus, and thus, the image quality can be improved. Moreover, when the input data is close proximity to the center value of the range corresponding to the specific grayscale value, it is converted into one of the grayscale values adjacent to the specific grayscale value by performing the pseudo-halftone processing with the probability according to the grayscale value of the input data. Accordingly, the reproducibility of the halftone is not lowered. Additionally, the second dither value is the value obtained by adding the value according to the color reduction to the first dither value. This eliminates the need for preparing a plurality of dither matrixes.

According to this method, the result of the determination may be rendered to be yes only when the reduced data is the specific grayscale value, and when the grayscale of the input data is contained in a range corresponding to the specific grayscale value and is contained in a range narrower than the range corresponding to the specific grayscale value. According to this modified determination, when a result of the determination is no, the specific grayscale value is slightly output.

In order to achieve the above-described object, a fourth image processing method of the present invention can be characterized in that data indicating a grayscale of a pixel is input and it is determined whether the input data is contained in a range which is to be converted into a specific grayscale value which may cause a defect in an output of an image output apparatus after a dither value is added to the input data, and after the number of levels of the input data is reduced to the number of levels which can be indicated by the image output apparatus. When a result of the determination is no, the dither value is added to the input data, and the number of levels of the input data is reduced to the number of levels which can be indicated by the image output apparatus, and the resulting data is output to the image output apparatus. When a result of the determination is yes, a doubled value of the dither value and a value according to the color reduction are added to the input data so as to convert the input data into data which specifies one of grayscale values adjacent to the specific grayscale value according to the addition result, and the resulting data is output to the image output apparatus.

According to this method, the grayscale which may cause a defect, such as flickering or fluctuation, is not used in the image output apparatus, and thus, the image quality can be improved. Moreover, when the input data is close proximity to the center value of the range corresponding to the specific grayscale value, it is converted into one of the grayscale values adjacent to the specific grayscale value by performing the pseudo-halftone processing with the probability according to the grayscale value of the input data. Accordingly, the reproducibility of the halftone is not lowered. Additionally, the second dither value is the value obtained by adding the value according to the color reduction to the first dither value. This eliminates the need for preparing a plurality of dither matrixes.

The third image processing method and the fourth image processing method are different merely in the order of the determination and the pseudo-halftone processing, and the results are the same.

In the fourth image processing method, the result of the determination may be rendered to be yes only when the input data is contained in a range narrower than the range which is to be converted into the specific grayscale value which may cause a defect in the image output apparatus. According to the modified determination, when a result of the determination is no, the specific grayscale value is slightly output.

In order to achieve the above-described object, according to any of the fifth, sixth, and seventh image processing methods of the present invention, pre-processing can be performed on input data indicating a grayscale of a pixel, pseudo-halftone processing is performed on the data subjected to the pre-processing, and post-processing is performed on w the data subjected to the pseudo-halftone processing, thereby reducing the number of levels of the input data into the number of levels which can be indicated by an image output apparatus.

The fifth image processing method can be characterized in that the pre-processing compresses a range from the center value corresponding to one of the grayscale values adjacent to a specific grayscale value which may cause a defect in an output of the image output apparatus to the center value corresponding to the other adjacent grayscale value into a range from the center value corresponding to one of the grayscale values adjacent to the specific grayscale value to the center value corresponding to the specific grayscale value. When the data subjected to the pseudo-halftone processing is the specific grayscale value, the post-processing shifts the grayscale value and then outputs the shifted value.

The sixth image processing method can be characterized in that the pre-processing compresses a range from the center value corresponding to one of grayscale values adjacent to a specific grayscale value which may cause a defect in an output of the image output apparatus to the center value corresponding to the other adjacent grayscale value into a range from the center value corresponding to one of the grayscale values adjacent to the specific grayscale value to the center value corresponding to the specific grayscale value. When the grayscale value of the input data is contained in a range including the center value corresponding to the specific grayscale value, and when the data subjected to the pseudo-halftone processing is the specific grayscale value, the post-processing shifts the grayscale value and then outputs the shifted value.

The seventh image processing method can be characterized in that the pre-processing compresses a range including the center value corresponding to a specific grayscale value which may cause a defect in an output of the image output apparatus into a range including a mean value of the center value corresponding to one of the grayscale values adjacent to the specific grayscale value and the center value corresponding to the specific grayscale value. When the grayscale value of the input data is contained in the range including the center value corresponding to the specific grayscale value, and when the data subjected to the pseudo-halftone processing is the specific grayscale value, the post-processing shifts the grayscale value and then outputs the shifted value.

According to the fifth image processing method, the grayscale which may cause a defect, such as flickering or fluctuation, is not used in the image output apparatus. According to the sixth and seventh image processing, the grayscale which may cause a defect is reduced in the image output apparatus. Accordingly, in any of the methods, the image quality can be improved. Further, according to any of the fifth, sixth, and seventh image processing methods, when the input data is close proximity to the center value of the range corresponding to the specific grayscale value, it is converted into one of the grayscale values adjacent to the specific grayscale value by performing the pseudo-halftone processing with the probability according to the grayscale value of the input data. Thus, the reproducibility of the halftone is not lowered. Additionally, since a complicated determination, such as that used in the third or fourth image processing method, is not employed, faster processing can be achieved.

In order to achieve the above-described object, a first image processing apparatus of the present invention includes a conversion circuit for converting data indicating a grayscale of a pixel into grayscale data which specifies a grayscale of an image output apparatus according to predetermined characteristics. When the input data corresponds to a specific grayscale value which may cause a defect in an output of the image output apparatus, the conversion circuit converts the whole or at least part of the input data into grayscale data which specifies a grayscale value other than the specific grayscale value, and supplies the converted grayscale data to the image output apparatus.

This arrangement is equivalent to an apparatus implemented by using the first image processing method. According to this arrangement, therefore, a grayscale which may cause a defect, such as flickering or fluctuation, is not used or is reduced in the image output apparatus, thereby improving the image quality.

In order to achieve the above-described object, a second image processing apparatus of the present invention is characterized by including a conversion circuit for converting data indicating a grayscale of a pixel into grayscale data which specifies a grayscale of an image output apparatus by reducing the number of levels of the input data according to predetermined characteristics, and by performing pseudo-halftone processing for displaying a halftone. The conversion circuit converts the whole or at least part of the data corresponding to a specific grayscale value which causes a defect in the image output apparatus into grayscale data which specifies one of grayscale values adjacent to the specific grayscale value, and supplies the converted data to the image output apparatus.

This arrangement is equivalent to an apparatus implemented by using the second image processing method. According to this arrangement, therefore, a grayscale which may cause a defect, such as flickering or fluctuation, is not used or is reduced in the image output apparatus when reducing the input data into the number of levels which can be displayed by the image output apparatus, thereby improving the image quality.

In order to achieve the above-described object, an electronic device of the present invention includes an image processing apparatus and an image output apparatus. The image processing apparatus converts data indicating a grayscale of a pixel into grayscale data which specifies a grayscale of the image output apparatus by reducing the number of levels of the input data according to predetermined characteristics and by performing pseudo-halftone processing for displaying a halftone. The image processing apparatus includes a conversion circuit that converts the whole or at least part of the input data corresponding to a specific grayscale value which may cause a defect in an image of the image output apparatus into the grayscale data which specifies one of grayscale values adjacent to the specific grayscale value, and the image forming apparatus outputs an image according to the grayscale data converted by the image processing apparatus. According to this arrangement, the grayscale which may cause a defect, such as flickering or fluctuation, is not used or is reduced in the image output apparatus, and thus, the image quality can be improved.

In order to achieve the above-described object, an image processing program of the present invention can be characterized by causing a computer for supplying grayscale data which specifies a grayscale of an image output apparatus to the image output apparatus to function as means for converting data indicating a grayscale of a pixel into the grayscale data by reducing the number of levels of the input data according to predetermined characteristics and by performing pseudo-halftone processing for displaying a halftone. The means converts the whole or at least part of the data corresponding to a specific grayscale value which may cause a defect in an output of the image output apparatus into the grayscale data which specifies one of grayscale values adjacent to the specific grayscale value, and supplies the converted grayscale data to the image output apparatus.

According to this function, the grayscale which may cause a defect, such as flickering or fluctuation, is not used or is reduced in the image output apparatus, and thus, the image quality can be improved.

Similarly, in order to achieve the above-described object, a computer-readable recording medium according to the present invention can be characterized by recording an image processing program thereon. The image processing program causes a computer for supplying grayscale data which specifies a grayscale of an image output apparatus to the image output apparatus to function as a converter that converts data indicating a grayscale of a pixel into the grayscale data by reducing the number of levels of the input data according to predetermined characteristics and by performing pseudo-halftone processing for displaying a halftone. The converter converts the whole or at least part of the data corresponding to a specific grayscale value which causes a defect in an output of the image output apparatus into the grayscale data which specifies one of grayscale values adjacent to the specific grayscale value, and supplies the converted grayscale data to the image output apparatus.

According to this function, the grayscale which may cause a defect, such as flickering or fluctuation, is not used or is reduced in the image output apparatus. Therefore, the image quality of a display can be improved.

BRIEF DESCRIPTION OF THE DRAWINGS

The invention will be described with reference to the accompanying drawings, in which like elements are referred to with like numerals, and wherein:

FIG. 4 illustrates the content of a table used in multi-level processing in the same image processing;

FIG. 9 is a table illustrating the conversion content of a look-up table in the same image processing;

FIG. 14 illustrates the content of a threshold table used in the same image processing;

FIG. 17 is a diagram illustrating an example of a dither matrix used in the same image processing;

FIG. 20 is a diagram illustrating an example of a dither matrix used in the same image processing;

FIG. 26 is a diagram illustrating the conversion content of post-processing in the same image processing;

FIG. 29 is a diagram illustrating the conversion content of post-processing applied to the first or second applied example of the fourth embodiment;

FIG. 31 is a diagram illustrating the conversion content of post-processing according to the third applied example of the fourth embodiment.

DETAILED DESCRIPTION OF PREFERRED EMBODIMENTS

Figure 1:
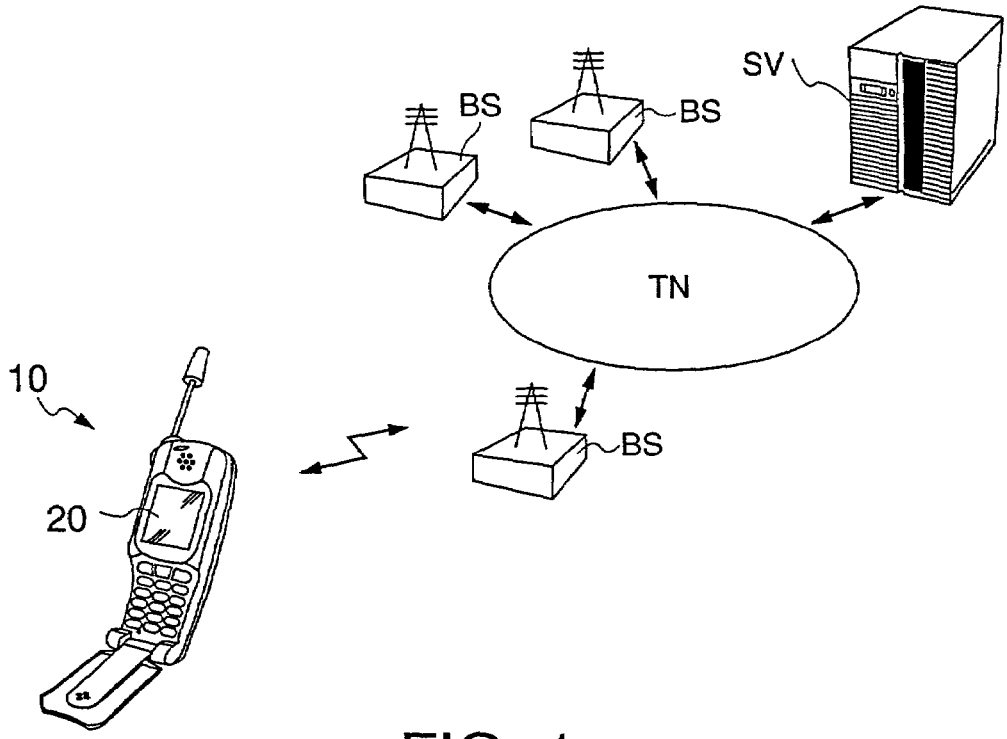
FIG. 1 is a diagram illustrating the system configuration of a cellular telephone or the like, which performs image processing according to a first embodiment of the present invention.

A description is first given of an image processing apparatus according to a first embodiment of the present invention. FIG. 1 illustrates the system configuration of a cellular telephone provided with image processing apparatus of the present invention. As shown in this figure, a cellular telephone 10 can be provided with a color LCD panel 20, and communicates with the base station BS which is in charge of the corresponding area (cell) among a plurality of base stations BS. The base stations BS are connected to a mobile communication network TN. A server SV for providing various services is also connected to the mobile communication network TN.

Figure 2:
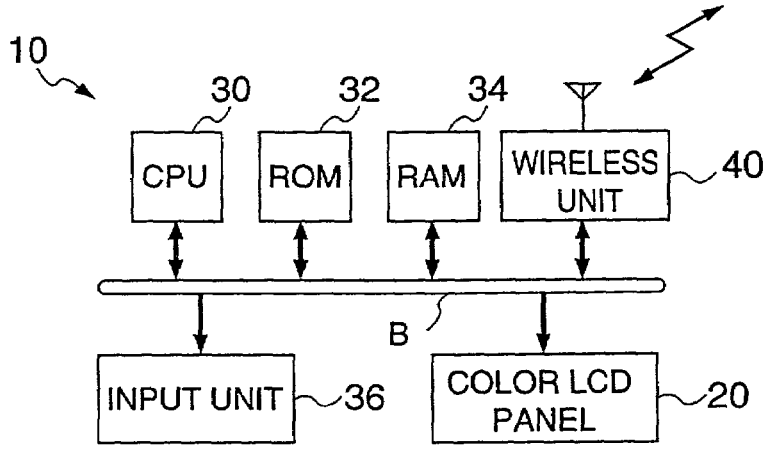
FIG. 2 is a block diagram illustrating the configuration of the same cellular telephone.

FIG. 2 is an exemplary block diagram illustrating the hardware configuration of the cellular telephone. As shown in this figure, the cellular telephone 10 is provided with the color LCD panel 20, a CPU 30, a ROM 32, a RAM 34, an input unit 36, and a wireless unit 40, and these elements are connected to each other via a bus B.

Among these elements, the color LCD panel 20 has an integrated drive circuit therein. Details of the color LCD panel 20 are as follows. One dot is formed of pixels of three colors, such as R (red), G (green), and B (blue), and the drive circuit is driven to display the grayscales of each R pixel, each G pixel, and each B pixel according to grayscale data of 3, 3, and 2 bits, respectively. Accordingly, on the color LCD panel 20, $256(=2^{(3+3+2)})$ colors are displayed for one dot.

On the color LCD panel 20, a STN (Super Twisted Nematic) passive matrix addressing method is employed, and also, the grayscales are displayed by the frame rate driving method. Thus, on the color LCD panel 20, by setting a pixel to a certain grayscale value, defects in the displayed images, such as flickering, may be generated. For convenience, the grayscale value which may cause defects is referred to as the "specific grayscale value".

The CPU 30 executes various types of computation and control, as discussed in greater detail below. The ROM 32 stores a basic input/output program, and so on, and the RAM 34 is used as a temporary storage area under the control of the CPU 30. The input unit 36 can be a button switch, such as a numeric keypad or an arrow key, that receives various operations from the user.

The wireless unit 40 performs wireless communication of audio information, image data, packet data, control information, and so on, with the base station BS under the control of the CPU 30, and also processes the received information and data.

The above-configured cellular telephone 10 is able to perform not only regular audio communication, but can also implement various functions by executing application programs. By executing, for example, a private information management program, the functions of managing schedules, addresses, memos, and the like can be implemented. By executing a mail sending/receiving program, the function of sending and receiving e-mail to and from other terminals can be implemented. By executing a browser program, the function of viewing various types of information provided by the server SV can be implemented.

Figure 3:
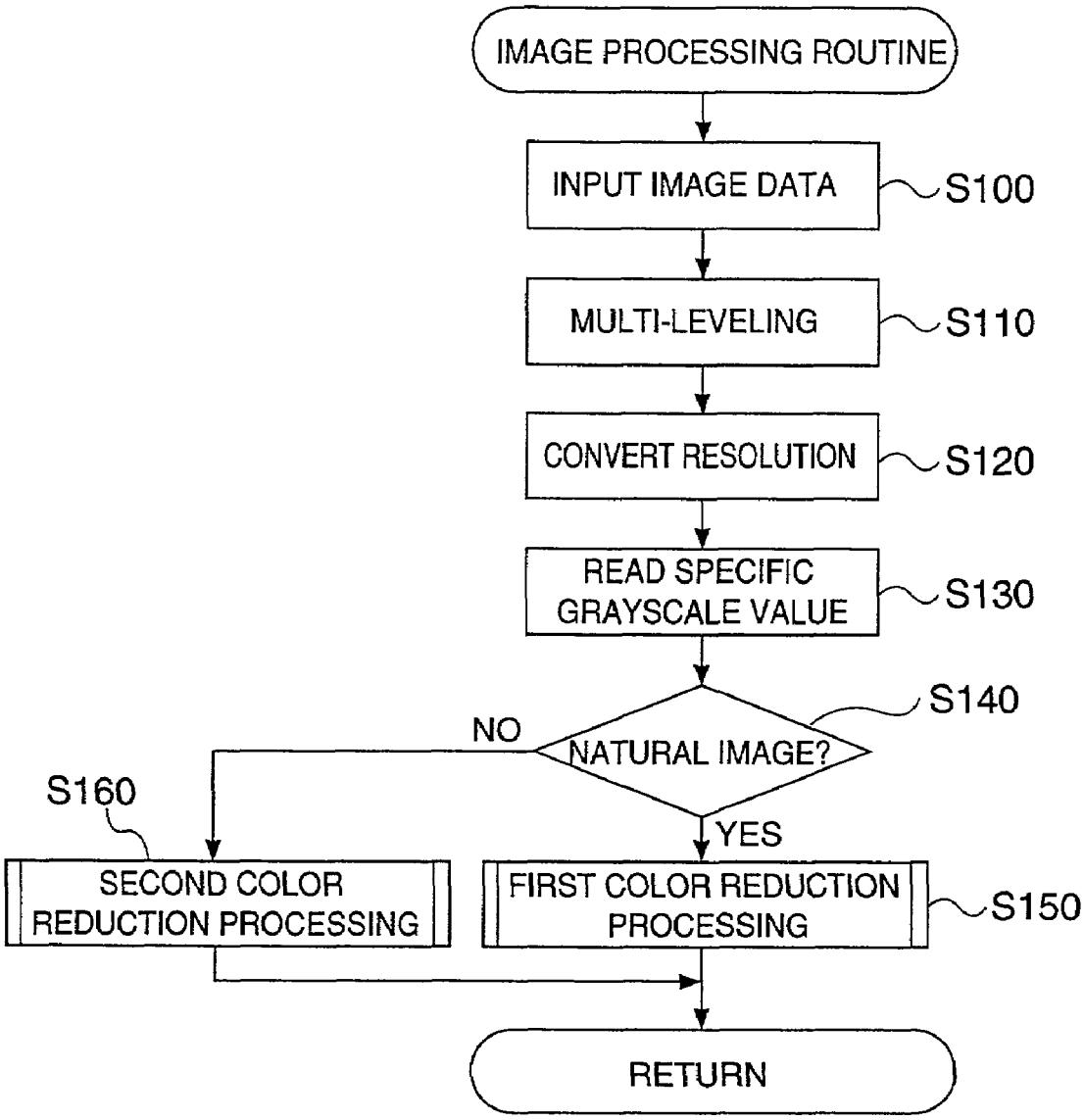
FIG. 3 is a flowchart illustrating the content of the image processing executed by the same cellular telephone.

Image processing to be executed by the CPU 30 of the cellular telephone 10 is described below. In the following description, the image processing is performed for processing GIF (Graphics Interchange Format) image data downloaded from the server SV according to the display capacity of the color LCD panel 20. FIG. 3 is a flowchart illustrating an exemplary image processing operation.

When this image processing program is started, image data to be processed is input and is stored in the RAM 34 (step S100). Then, multi-level processing is performed, i.e., the number of bits of the input image data is increased (step S110). The reason for performing multi-level processing is to temporarily increase the number of colors which can be handled in the GIF formation, i.e., 256 colors (8 bits) or less, to 24 bits which can be processed in the cellular telephone 10.

In actuality, this multi-level processing is performed by conversion processing using the table shown in FIG. 4. More specifically, the table in accordance with the image data to be processed is set in the RAM 34, and by referring to the set table, the 8-bit palette index color indicated by the image data is converted into R, G, and B, each having 8 bits (a total of 24 bits). The content of the table shown in FIG. 4 is an example only, and it varies according to the image data to be processed.

The resolution of the downloaded image data is not necessarily the same resolution as that which can be displayed by the color LCD panel 20 (or the resolution in a range preset by the browser). Accordingly, the resolution of the image data subjected to multi-level processing is converted into the resolution of the color LCD panel 20 (or into the designated resolution) (step S120).

Then, data indicating a grayscale value which may cause a defect when displaying the image data on the color LCD panel 20 is read (step S130). As discussed above, on the color LCD panel 20, the grayscales of the R, G, and B pixels are displayed according to the 3, 3, and 2-bit grayscale data, respectively. Accordingly, R and G can be displayed with 8 levels from [0] to [7], while B can be displayed with 4 levels from [0] to [3]. In the description of this specification, the numbers in [ ] indicate decimal numbers.

In this embodiment, it is assumed that a defect is caused in the displayed image data on the color LCD panel 20 if the grayscale value of R and G, whose colors are reduced from 256 levels to 8 levels, is [3]. Thus, in this embodiment, in step S130, the data indicating the grayscale value [3] is read. A defect is not caused in the displayed image data for B, whose color is reduced to 4 levels.

It is then determined whether the image indicated by the input image data is a natural image, such as a natural picture or a photograph (step S140). This is determined by, for example, whether the number of levels representing the image is a predetermined value or greater. If the number of levels is a predetermined value or greater, it is determined that the image is a natural image, and first color reduction processing is executed (step S150). In contrast, if the number of levels of the image is less than the predetermined value, it is determined that the image is not a natural image, and second color reduction processing is executed (step S160).

The first color reduction processing is as follows. According to this first color reduction processing, in the image data defined by R, G, and B, each having 8 bits (each 256 levels), R and G are reduced to the 7 levels other than the grayscale value [3] which may cause a defect in the displayed image data rather than to 3 bits (8 levels), and B is reduced to 2 bits (4 levels). Then, the resulting image data can be displayed in the color LCD panel 20. Also in this embodiment, in order to prevent the generation of unnatural outlines, which may be caused by the concentration of the same grayscale values, while the color reduction processing is performed on the natural image, a dithering technique is employed for comparing the original grayscale values with the corresponding threshold values in a dither matrix.

For convenience, among the image indicated by the image data to be processed, a grayscale value of a designated pixel is represented by DX, and a grayscale value of converted grayscale data (which has been subjected to color reduction processing) is indicated by CDX.

In order to assign the grayscale values DX having the 256 levels from [0] to [255] to 8 levels according to the dithering technique, in general, the 256 levels are divided into the 7 levels by using six threshold values TH1, TH2, TH3, . . . , TH6 (TH1<TH2<TH3, <TH6), and then, the divided grayscale values are compared with the threshold values of the dither matrix. Then, according to the comparison result, the grayscale value is set to one of the converted grayscale values CDX.

In this embodiment, however, a defect may be caused on the color LCD panel 20 if an R (red) or G (green) pixel having the grayscale value [3] is displayed. It is thus necessary to prevent the grayscale value DX from being converted into the grayscale value CDX [3].

Accordingly, in the first color reduction processing, the threshold value TH4 corresponding to the grayscale value DX [3] of the designated pixel of the image data read in step S130 is not used. Additionally, the data which is greater than or equal to the threshold value TH3 and smaller than the threshold value TH5 is compared with the corresponding threshold of the dither matrix, and according to the comparison result, the data is converted into [2] or [4] adjacent to the grayscale value [3]. As a result, the grayscale value DX can be prevented from being converted into the grayscale value CDX [3].

Figure 5:
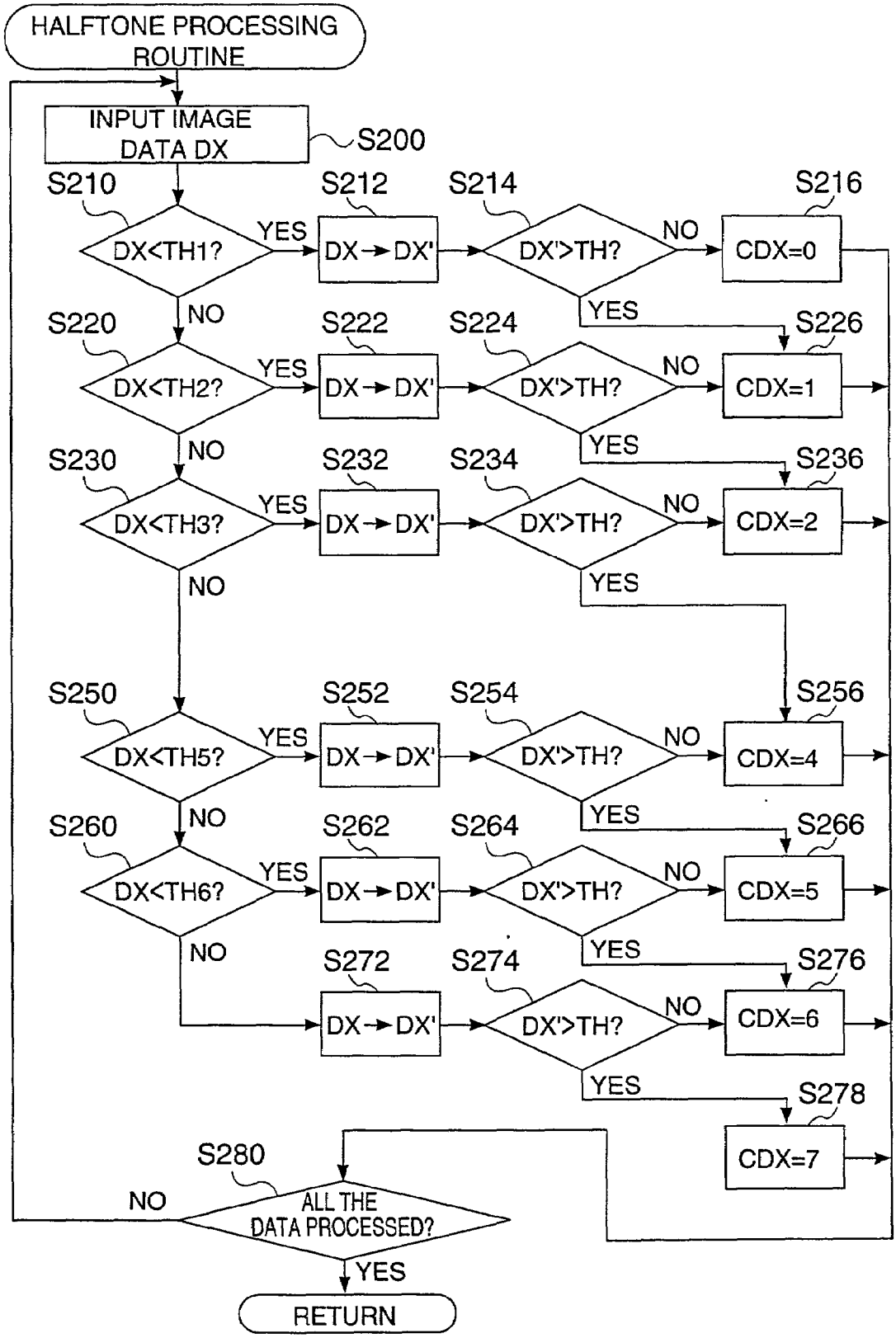
FIG. 5 is a flowchart illustrating details of first color reduction processing in the same image processing.

FIG. 5 is a flowchart illustrating the content of the first color reduction processing. Although the first color reduction processing is performed on each of the R, G, and B colors, an example is given below in which the 256 levels of R data are reduced to 7 levels.

Figure 6:
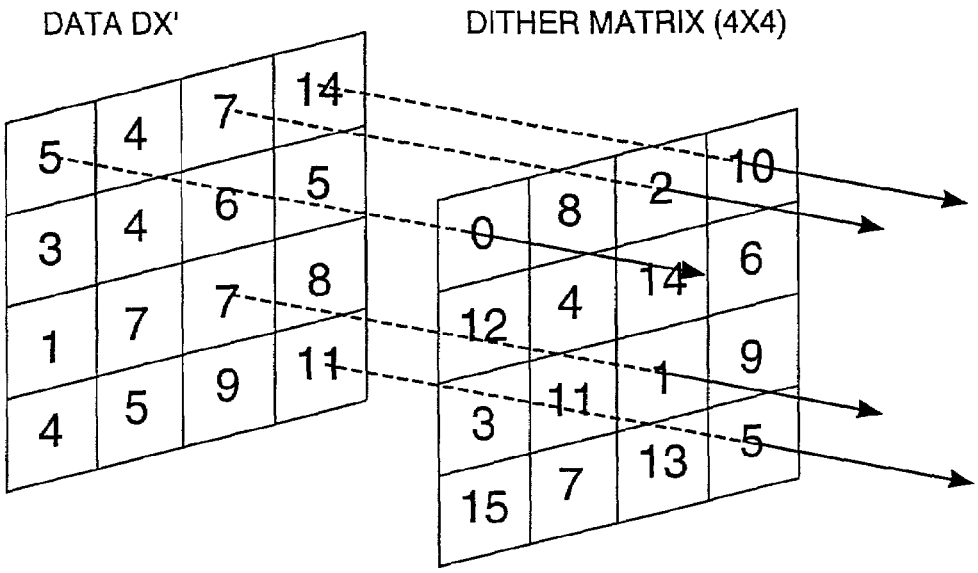
FIG. 6 is a diagram illustrating an example of a dither matrix used in the same image processing.

As the dither matrix used in the dithering technique, a 4×4-square matrix, such as that shown in FIG. 6, is used, and the reduced grayscale value CDX is determined according to whether the normalized value DX', which is described below, is greater than the corresponding threshold value of the dither matrix. The dither matrix is not restricted to that shown in FIG. 6. A matrix having a different size may be used. Alternatively, a matrix having a different threshold arrangement may be used, for example, one in which the threshold value becomes progressively greater from the center to the exterior.

In FIG. 5, when the first color reduction processing is started, the image data determined to be a natural image is input (step S200). Then, it is determined whether the grayscale value DX of the designated pixel is smaller than the threshold value TH1 (step S210). If the grayscale value DX is smaller than the threshold value TH1, it is normalized to fall within the threshold range of the dither matrix, i.e., from [0] to [15], and the normalized value is set to be DX' (step S212). For example, if the grayscale value is [24] when the threshold value TH1 is [36], the normalized value is found by the following equation:

$$DX'=15\cdot DX/TH1$$

and thus results in [10].

Subsequently, it is determined whether the normalized value DX' obtained in step S212 is greater than the threshold value TH of the dither matrix corresponding to the designated pixel (step S214). If the normalized value DX' is smaller than the threshold value TH, the grayscale value CDX of the designated pixel is set to be [0] (step S216). If the normalized value DX' is greater than the threshold value TH, the grayscale value CDX of the designated pixel is set to be [1] (step S226).

On the other hand, if it is determined in step S210 that the grayscale value DX is greater than or equal to the threshold value TH1, a determination is further made as to whether the grayscale value DX is smaller than the threshold value TH2 (step S220). If the grayscale value DX is smaller than the threshold value TH2, it is normalized to fall within the threshold range of the dither matrix, and the normalized value is set to be DX' (step S222). In this case, the normalized value DX' is found by the following equation:

$$DX'=15\cdot(DX-TH1)/(TH2-TH1).$$

Then, it is determined whether the normalized value DX' obtained in step S222 is greater than the threshold value TH of the dither matrix corresponding to the designated pixel (step S224). If the normalized value DX' is smaller than the threshold value TH, the grayscale value CDX of the designated pixel is set to be [1] (step S226). If the normalized value DX' is greater than the threshold value TH, the grayscale value CDX of the designated pixel is set to be [2] (step S236).

If it is determined in step S220 that the grayscale value DX is greater than or equal to the threshold value TH2, a determination is further made as to whether the grayscale value DX is smaller than the threshold value TH3 (step S230). If the grayscale value DX is smaller than the threshold value TH3, it is normalized to fall within the threshold range of the dither matrix, and the normalized value is set to be DX' (step S232). In this case, the normalized value DX' is found by the following equation:

$$DX'=15\cdot(DX-TH2)/(TH3-TH2).$$

Then, it is determined whether the normalized value DX' obtained in step S232 is greater than the threshold value SH of the dither matrix corresponding to the designated pixel (step S234). If the normalized value DX' is smaller than the threshold value TH, the grayscale value CDX of the designated pixel is set to be [2] (step S236). If the normalized value DX' is greater than the threshold value TH, the grayscale value CDX of the designated pixel is set to be [4] rather than [3] (step S256).

If it is determined in step S230 that the grayscale value DX is greater than or equal to the threshold value TH3, a determination is further made as to whether it is smaller than the threshold value TH5 (step S250). If the grayscale DX is less than the threshold value TH5, it is normalized to be fall within the threshold range of the dither matrix, and the normalized value is set to be DX' (step S252). In this case, the normalized value DX' is found by the following equation:

$$DX'=15\cdot(DX-TH3)/(TH5-TH3).$$

Then, it is determined whether the normalized value DX' obtained in step S252 is greater than the threshold value TH of the dither matrix corresponding to the designated pixel (step S254). If the normalized value DX' is smaller than the threshold value TH, the grayscale value CDX of the designated pixel is set to be [4] (step S256). If the normalized value DX' is greater than the threshold value TH, the grayscale value CDX of the designated pixel is set to be [5] (step S266).

Similarly, if it is determined in step S250 that the grayscale value DX is greater than or equal to the threshold value TH5, a determination is further made as to whether the grayscale value DX is smaller than the threshold value TH6 (step S260). If the grayscale value DX is smaller than the threshold value TH6, it is normalized to fall within the threshold range of the dither matrix, and the normalized value is set to be DX' (step S262). In this case, the normalized value DX' is found by the following equation:

$$DX'=15\cdot(DX-TH5)/(TH6-TH5).$$

Then, it is determined whether the normalized value DX' obtained in step S262 is greater than the threshold value TH of the dither matrix corresponding to the designated pixel (step S264). If the normalized value DX' is smaller than the threshold value TH, the grayscale value CDX of the designated pixel is set to be [5] (step S266). If the normalized value DX' is greater than the threshold value TH, the grayscale value CDX of the designated pixel is set to be [6] (step S276).

Similarly, if it is determined in step S260 that the grayscale value DX is greater than or equal to the threshold value TH6, it is normalized to fall within the threshold range of the dither matrix, and the normalized value is set to be DX' (step S272). In this case, the normalized value DX' is found by the following equation:

$$DX'=15\cdot(DX-TH6)/(255-TH6).$$

Then, it is determined whether the normalized value DX' obtained in step S272 is greater than the threshold value TH of the dither matrix corresponding to the designated pixel (step S274). If the normalized value DX' is smaller than the threshold value TH, the grayscale value CDX of the designated pixel is set to be [6] (step S276). If the normalized value DX' is greater than the threshold value TH, the grayscale value CDX of the designated pixel is set to be [7] (step S278).

It is then determined whether steps S200 through S278 have been performed for all the pixels of the input image data (step S280). If the determination result is no, the designated pixel is shifted to another pixel, and the process returns to step S200 so that the processing is executed on all the pixels. In contrast, if the determination result is yes, the first color reduction processing on R (red) is completed.

The first color reduction processing performed on R has been described by way of example. Concerning G (green) which may cause a problem similar to that occurring in R, color reduction processing is similarly performed so as to obtain 7-level grayscale values CDX other than [3] among the 8 levels from [0] to [7].

As for B (blue), a defect does not occur in the displayed image, as discussed above. Thus, according to regular pseudo-halftone processing, B is reduced from 256 levels to 4 levels. If any defect occurs when displaying a certain grayscale value of B, processing for preventing such grayscale value may be performed.

In this example, although the dithering technique is used as an example for reproducing pseudo-halftones, it is to be understood that other techniques, such as an error diffusion technique, may be applied.

Second color reduction processing executed in step S160 of FIG. 3 is described below. If the image to be displayed is not a natural image, but an image such as a character or a line, the distribution of the grayscale values of the image data is not uniform. Thus, pseudo-halftone processing according to, for example, the dithering technique, preferably should not be performed, and then better image quality can be obtained.

Figure 7:
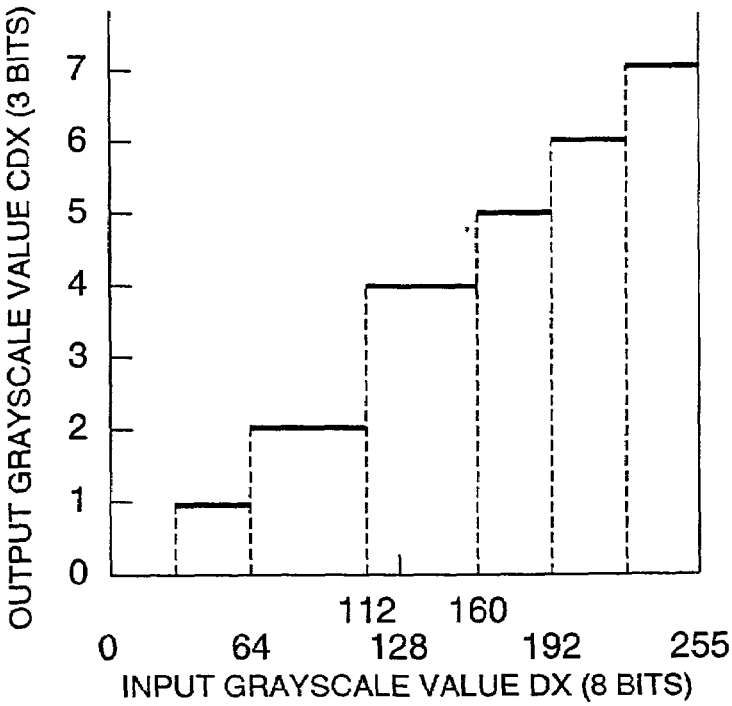
FIG. 7 is a diagram illustrating an example of the input/output allocation of second color reduction processing in the same image processing.

Accordingly, in the second color reduction processing, 256 levels from [0] to [255] are assigned, as shown in FIG. 7, to 7 levels other than [3] among the 8 levels from [0] to [7]. More specifically, the grayscale value CDX [3] which may cause a defect in the displayed image is not output. Instead, the input ranges [2] and [4], which are adjacent to [3], are increased to a range from [64] to smaller than [112] and a range from [112] to smaller than [160], respectively (normally, if the input grayscale value DX is in a range from [96] to smaller than [128], the grayscale value is set to be [3]).

In this embodiment, the first color reduction processing or the second color reduction processing is executed according to the determination result whether or not the image indicated by the input image data is a natural image, such as a natural picture or a photograph. Alternatively, one of the color reduction processings may be performed without making the determination. Additionally, the resolution conversion is not performed if it is not necessary.

In this embodiment, only the ranges of the grayscale values DX assigned to the grayscale values CDX [2] and [4] are increased. However, the ranges of the grayscale values DX assigned to the grayscale values CDX [1], [2], [4], [5], [6], and [7] may be equally set.

The above-described conversion is performed on R and G. Concerning B, the grayscale values DX from [0] to [255] are equally divided into four blocks, and the ranges of the individual blocks are assigned to the grayscale values CDX, such as [0], [1], [2], and [3], respectively.

Upon completion of the first or second color reduction processing, the reduced grayscale data in which grayscale values CDX of R and G are set to 7 levels other than [3], and in which grayscale values CDX of B are set to 4 levels, is supplied to the color LCD panel 20. The resulting image is displayed on the color LCD panel 20 in accordance with this grayscale data. Accordingly, grayscale values which may cause defects, such as flickering or fluctuation, are not displayed on the color LCD panel 20, thereby preventing a decrease in the image quality of the display screen.

Since this image processing includes computer processing, it may be formed as a program implementing this processing or a computer-readable recording medium on which this program is recorded. As this recording medium, not only a flexible disk, a CD-ROM, a magneto-optical disk, an IC card, and a ROM cartridge, but also a punch card, printed matter on which codes, such as bar codes, are printed, computer-integrated storage units (memory, such as a RAM or a ROM), and various media, such as media which can be read by a computer by using an external storage device, may be used.

In the above-described first color reduction processing according to the first embodiment, the grayscale value which may generate defects in the image displayed on the color LCD panel 20 is completely eliminated. However, simply by decreasing the frequency of occurrence of such a grayscale value, a decrease in the image quality is unnoticeable. Accordingly, first, second, and third applied examples are described below in which, instead of completely eliminating the grayscale value which may cause defects in the displayed image, the frequency of occurrence of such a grayscale value is instead decreased.

Figure 8:
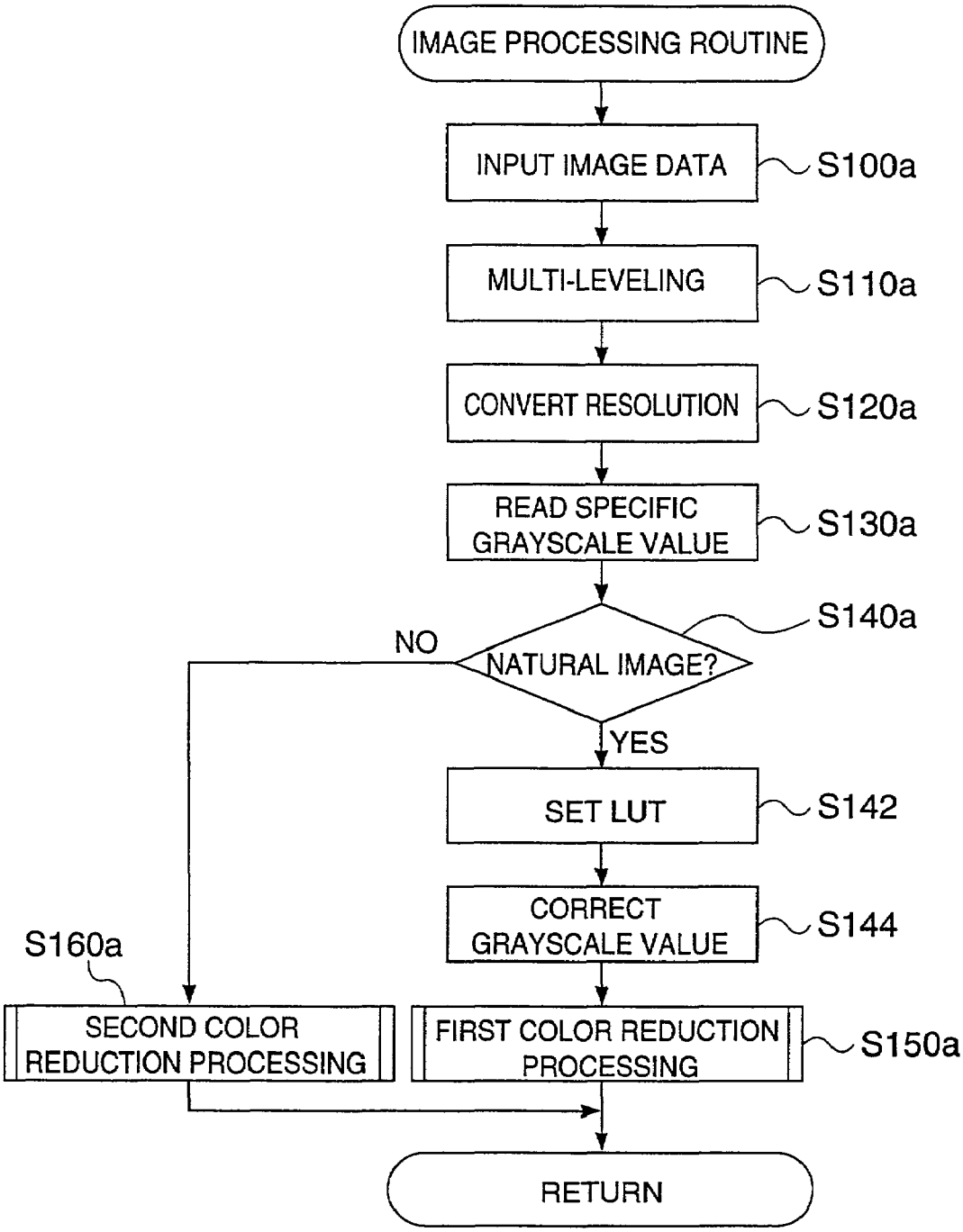
FIG. 8 is a flowchart illustrating the content of image processing according to a first applied example of the first embodiment.

The first applied example employs a technique for correcting the grayscale value of the image data to be input by using a tone curve, which is stated below, so as to convert part of the grayscale values. FIG. 8 is a flowchart illustrating the content of image processing according to the first applied example. Steps S100*a* through S140*a* are similar to steps S100 through S140, respectively, of FIG. 3, and thus, only step S142 and the subsequent steps are discussed below.

If it is determined in step S140*a* that the input image data is a natural image, a look-up table is set in the RAM 34 according to the grayscale value read in step S130*a*, i.e., the data indicating the grayscale value which may cause a defect in the displayed image (step S142). By referring to this look-up table, the grayscale value DX of the image data is corrected (step S144).

The setting of the look-up table and correction of the grayscale value DX using the look-up table are performed for both R (red) and G (green). Concerning B (blue), as discussed above, it is assumed that there is no grayscale value which may cause a defect in the image displayed on the color LCD panel 20. Accordingly, it is not necessary to set a look-up table and correct the grayscale value using the look-up table for B. If, however, concerning B, there is a grayscale value which may cause a defect on the displayed image, the setting of a look-up table and the correction for such a grayscale value have to be performed.

Figure 10:
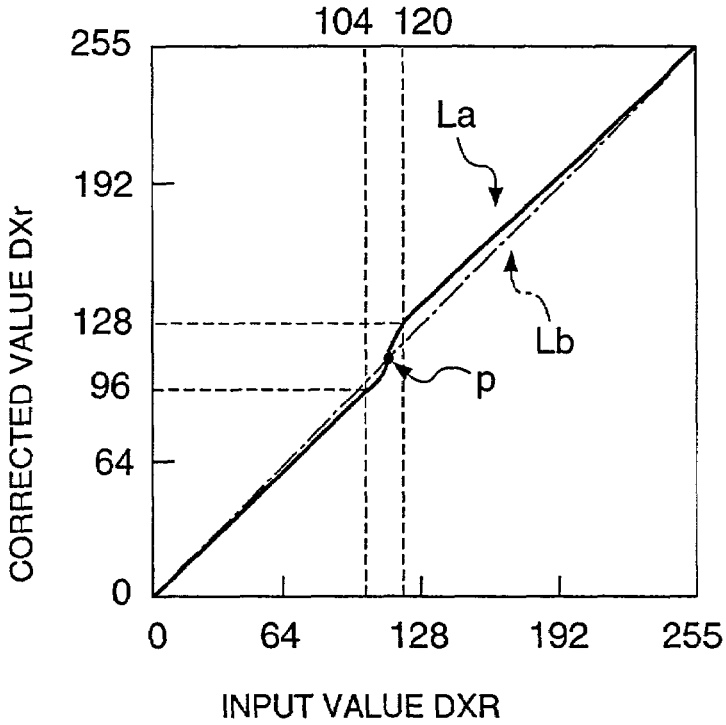
FIG. 10 is a diagram illustrating tone curve characteristics indicating the same conversion content.

The setting of the look-up table and correction of the grayscale value by referring to this look-up table for R are described below by way of example. FIG. 9 illustrates the conversion content in the R look-up table. FIG. 10 illustrates conversion characteristics (tone curve) in which the input side indicates the uncorrected grayscale value DXR, and the output side represents the corrected grayscale value DXr. The look-up table shown in FIG. 9 is set and the conversion characteristic shown in FIG. 10 is obtained, assuming that the grayscale value CDX which may cause a defect in the image displayed on the color LCD panel 20 is [3].

A tone curve La shown in FIG. 10 indicates that, for example, data of the grayscale value DXR [104] is corrected to data of the grayscale value DXr [96]. According to the tone curve La, the grayscale value DXR on the input side located in an area smaller than point p corresponding to the grayscale value CDX [3] is corrected to a smaller grayscale value DXr, and the grayscale value DXR located in an area greater than point p is corrected to a greater grayscale value DXr.

The characteristics resulting when correction is not made are indicated by a one-dot-chain line Lb in FIG. 10, in which the grayscale value DXR on the input side is directly output as the grayscale value DXr on the output side.

Figure 11:
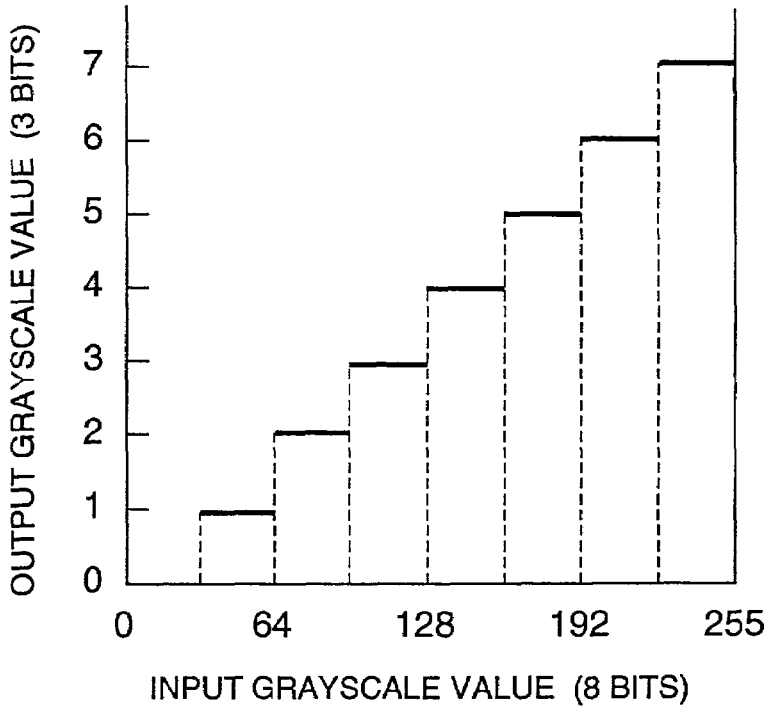
FIG. 11 is a diagram illustrating the allocation when 256 levels are simply reduced to 8 levels.

According to this tone curve, the proportion of the grayscale values DXr ranging from [96] to [128] is decreased, and on the other hand, the proportion of the grayscale values DXr ranging from [0] to [96] and from [128] to [255] is accordingly increased. The reason for decreasing the proportion of the grayscale values DXr from [96] to [128] is as follows. As shown in FIG. 11, when the 256 levels from [0] to [255] are equally divided into 8 areas, and the individual areas are simply assigned to the 8 levels, the area corresponding to the grayscale value [3] results in DXr [96] to [128]. Accordingly, if a defect in the displayed image occurs because of another grayscale value, for example, [5], the proportion of the grayscale values from [160] to [192] corresponding to the grayscale value [5] may be decreased.

That is, to set the look-up table in step S142 is to adjust the relationships between the input side and the output side so that the range corresponding to the grayscale value read in step S130*a* can be decreased. However, instead of adjusting the relationships between the input side and the output side, a plurality of look-up tables in accordance with the grayscale values may be prepared in the ROM 32 or the RAM 34 in advance, and the table corresponding to the grayscale value read in step S130*a* may be selected.

Although in this example the tone curve is linear, it is to be understood that alternative curves may be used, such as a curve with gamma characteristics for correcting the input/display characteristics of the color LCD panel.

Instead of using the look-up table, the grayscale value DXR may be determined by computation and using functions.

After the corrected grayscale value DXr is obtained in step S144, the first color reduction processing is performed (step S150*a*). According to this first color reduction processing, the image data, each pixel being defined by R, G, and B, each having 8 bits (each 256 levels), is reduced. More specifically, R and G are reduced to 3 bits (each 8 levels), and B is reduced to 2 bits (4 levels). In the first color reduction processing, the dithering technique is applied, as in the first embodiment.

Figure 12:
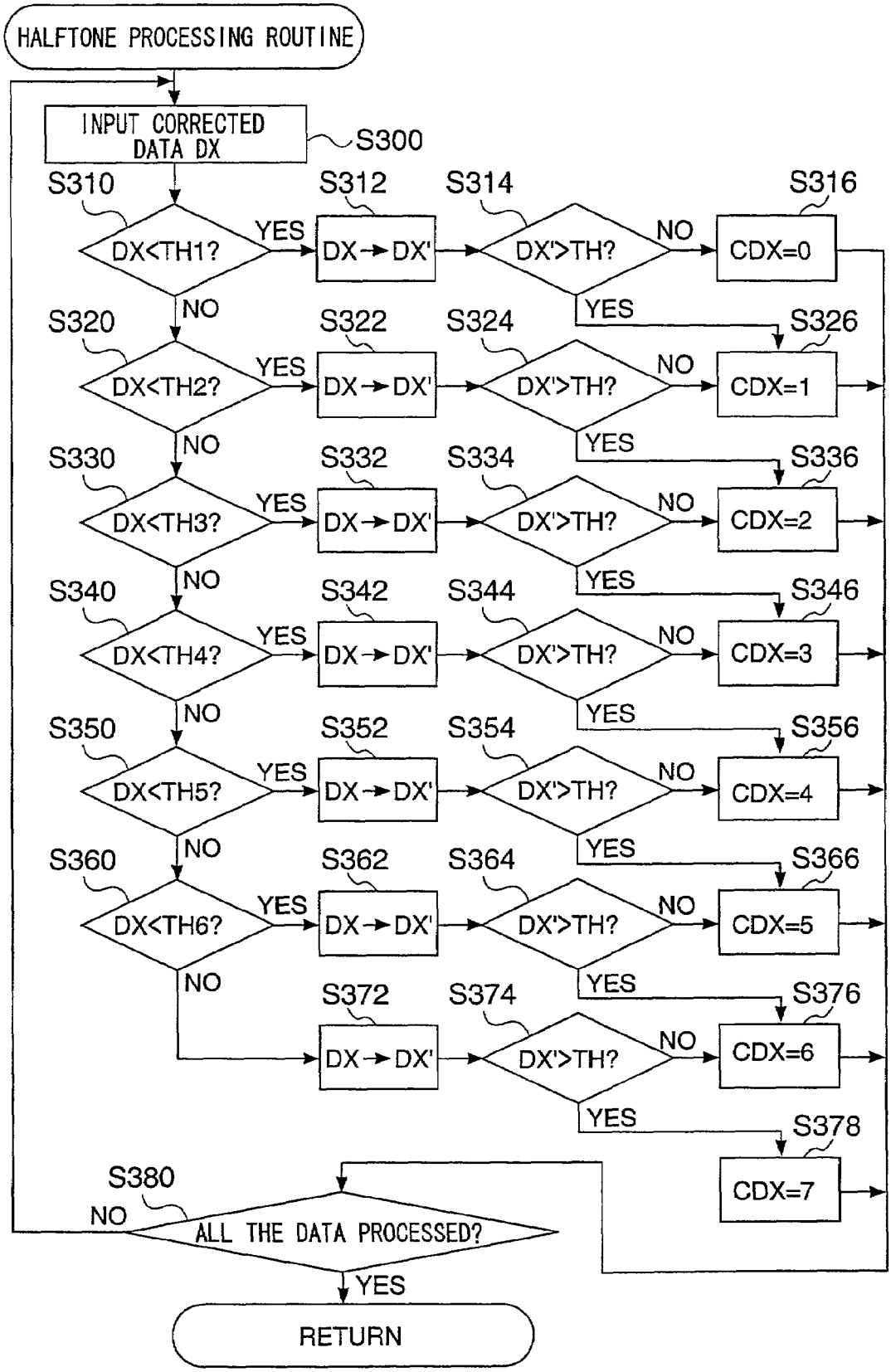
FIG. 12 is a flowchart illustrating details of first color reduction processing in the first applied example.

FIG. 12 is a flowchart illustrating the content of the first color reduction processing used in this first applied example. The first color reduction processing shown in FIG. 12 differs from that shown in FIG. 5 in that the threshold value TH4 is used, and accordingly, the grayscale value CDX may be [3] (step S346). As in the first color reduction processing of the first applied example, processing from steps S300 through S380 is performed on all the R and G pixels, and processing for subtracting the grayscale value to 4 levels is executed on B.

The second color reduction processing in step S160*a* is similar to that of the first embodiment shown in FIG. 3.

Upon completion of the first or second color reduction processing, the reduced grayscale data is supplied to the color LCD panel 20, and the image is displayed according to this grayscale data. By performing the first color reduction processing in the first applied example, the grayscale data in which R and G are defined by the 8 levels with the reduced distribution of the grayscale value CDX [3] according to the look-up table, and B is defined by the 4 levels is supplied to the color LCD panel 20. Accordingly, the grayscale value which may cause a defect in the displayed image is displayed. However, the frequency of occurrence of such a grayscale value is low, and thus, the decrease in the image quality on the display screen is made negligible.

In the first applied example, the frequency of occurrence of such a grayscale value is decreased as follows. After the distribution of the range corresponding to the grayscale value which may cause a defect is decreased by using the look-up table, the first color reduction processing is executed. However, instead of using the look-up table, the threshold used in the first color reduction processing may be changed, in which case, advantages similar to those obtained in the first applied example can be offered.

Accordingly, a second applied example in which the threshold in the first color reduction processing is changed is discussed below.

Figure 13:
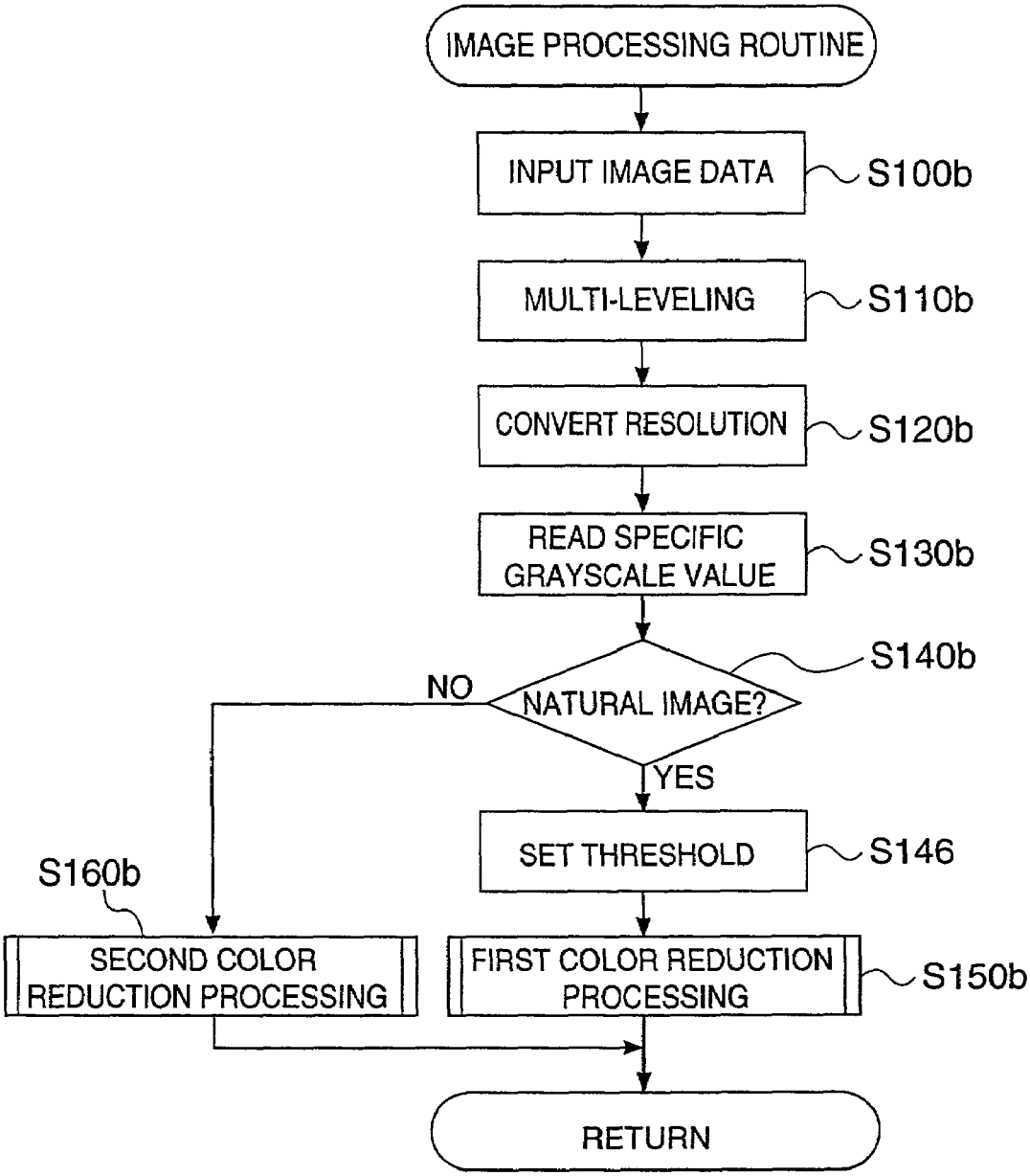
FIG. 13 is a flowchart illustrating the content of image processing according to a second applied example of the first embodiment.

FIG. 13 is a flowchart illustrating the content of image processing according to the second applied example. Steps S100*b* through S140*b* are similar to steps S100 through S140, respectively, of FIG. 3. Accordingly, step S146 and the subsequent steps are described below.

If it is determined that the image data input in step S140*b* is a natural image, the grayscale value read in step S130*b*, i.e., the threshold value corresponding to the data indicating the grayscale value which may cause a defect in the displayed image, is set by referring to a threshold table (step S146).

The threshold table is a table which is permanently stored in the ROM 32 (or stored in the RAM 34 immediately after starting this image processing). The threshold table defines, as shown in FIG. 14, the relationships of the threshold values indicated by TH1, TH2, TH3, . . . , TH6 shown in FIG. 12 to the grayscale values CDX which may cause defects in the displayed image.

The threshold values TH1, TH2, TH3, . . . , TH6 without hatched portions in FIG. 14 are the same threshold values in FIG. 12. The hatched threshold values are specific in this second applied example, and the following relationships are set in order to reduce the range corresponding to the grayscale values CDX.

TH01<(TH1)<TH 11<TH21<(TH2)<TH22<TH32<(TH3)<TH33<TH43<(TH3)<TH44<TH54<(TH5)<TH55<TH65<(TH6)<TH66<TH67

Also, in this applied example, it is assumed that a defect occurs in the displayed image on the color LCD panel 20 when the grayscale value of the R (red) and G (green) pixels is [3]. Accordingly, the data indicating the grayscale value [3] is read in step S130. Accordingly, in step S146, the threshold values TH1, TH2, TH33, TH43, TH5, and TH6 corresponding to the grayscale value CDX [3] are respectively set to the threshold values TH1, TH2, TH3, . . . , TH6 shown in FIG. 12. Because of the relationships TH3<TH33<TH43<TH4, as discussed above, the input range corresponding to the grayscale value CDX [3] is decreased.

If the grayscale value CDX which may cause a defect in the displayed image is [5], the threshold values TH1, TH2, TH3, TH4, TH55, and TH65 are respectively set to be the threshold values TH1, TH2, TH3, . . . , TH6 shown in FIG. 12, and then, the input range corresponding to the grayscale value CDX [5] is decreased.

Then, first color reduction processing using the threshold values set as TH1, TH2, TH3, . . . , TH6 is performed (step S150*b*). Second color reduction processing in step S160*b* is similar to that of the first embodiment shown in FIG. 3.

Upon completion of the first or second color reduction processing, the reduced grayscale data is supplied to the color LCD panel 20, and the image is displayed according to this grayscale data. By performing the first color reduction processing in the second applied example, the grayscale data in which R and G are defined by 8 levels with the reduced distribution of the grayscale value CDX [3] by changing the threshold values and in which B is defined by 4 levels is supplied to the color LCD panel 20. Accordingly, the grayscale value which may cause a defect in the displayed image is displayed. However, the frequency of occurrence of such a grayscale value is low, and thus, the decrease in the image quality on the display screen can be made negligible.

Figure 15:
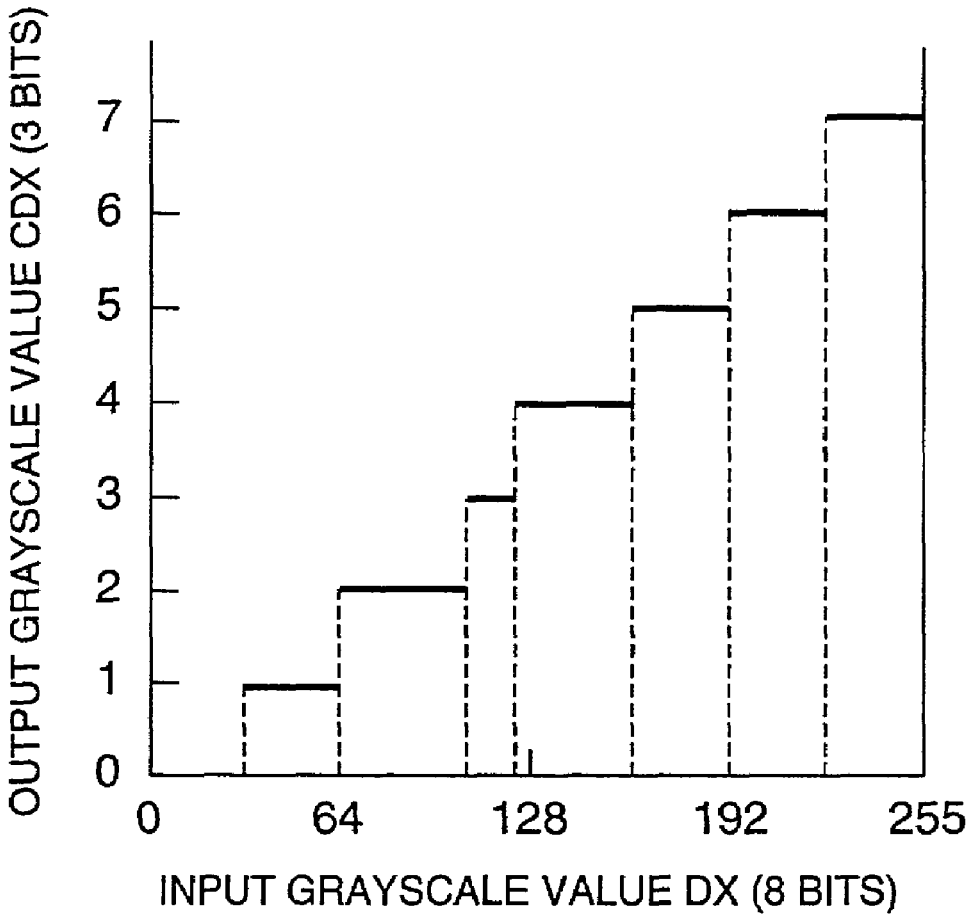
FIG. 15 is a diagram illustrating the allocation of the output of the image processing according to a third applied example of the first embodiment.

In the first and second applied examples, the frequency of occurrence of the grayscale value CDX which may cause a defect in the displayed image is reduced in the first color reduction processing. Alternatively, the allocation of the 256-level data to 8 levels may be changed. FIG. 15 illustrates the applied allocation. As shown in this figure, the range of the input grayscale value DX output to the grayscale value CDX [3] which may cause a defect in the displayed image is decreased. According to this allocation, the frequency of occurrence of the grayscale value which may cause a defect in the displayed image can also be reduced, and thus, the decrease in the display quality can be made negligible. According to this applied example, it can be interpreted that the first color reduction processing and the second color reduction processing are the same.

In the first embodiment, since the input image data is not converted into the grayscale value which may cause a defect in the displayed image, or the frequency of occurrence of such a grayscale value is decreased, the display quality of the color LCD panel 20 can be prevented from being lowered. In the first embodiment, however, the grayscale characteristics of the color LCD panel 20 are not uniform, and thus, the reproducibility of the halftone grayscale is thus lowered.

The reason is as follows. If the 256 levels are converted into the 8 levels other than the grayscale value [3], the grayscale value [112] of the 256 levels corresponding to the center of the grayscale value [3] should ideally be converted into the grayscale values and [4] with substantially 50% probability each. In the first embodiment, however, the input image data is subjected to pseudo-halftone processing after having the grayscale value information removed, which would originally be provided with the image, because it has been allocated before being compared with the threshold value of the dither matrix (step S210 of FIG. 5 or step S310 of FIG. 12). Alternatively, the image data is subjected to pseudo-halftone processing after being corrected with a tone curve (step S144 of FIG. 8). Thus, it cannot be expected that the grayscale value will ideally be converted as discussed above. As a result, in the first embodiment, the grayscale value [112] in the 256 levels is biased to either the grayscale value [2] or [4] of the 8 levels. As a result, the overall balance of the grayscale characteristics of the color LCD panel 20 is disturbed.

Accordingly, in a second embodiment, a decrease in the reproducibility of the halftone grayscale can be prevented while a grayscale which may cause a defect in the displayed image is not displayed. The image processing according to the second embodiment is similar to that of FIG. 3 except for step S150, and an explanation of the identical steps will thus be omitted. For further simple representation, an explanation of a recursive process for performing the processing on all the pixels and a process for presetting or clearing the required values will also be omitted. Unlike the first embodiment, in the second embodiment, 256 levels are reduced to 16 levels.

Figure 16:
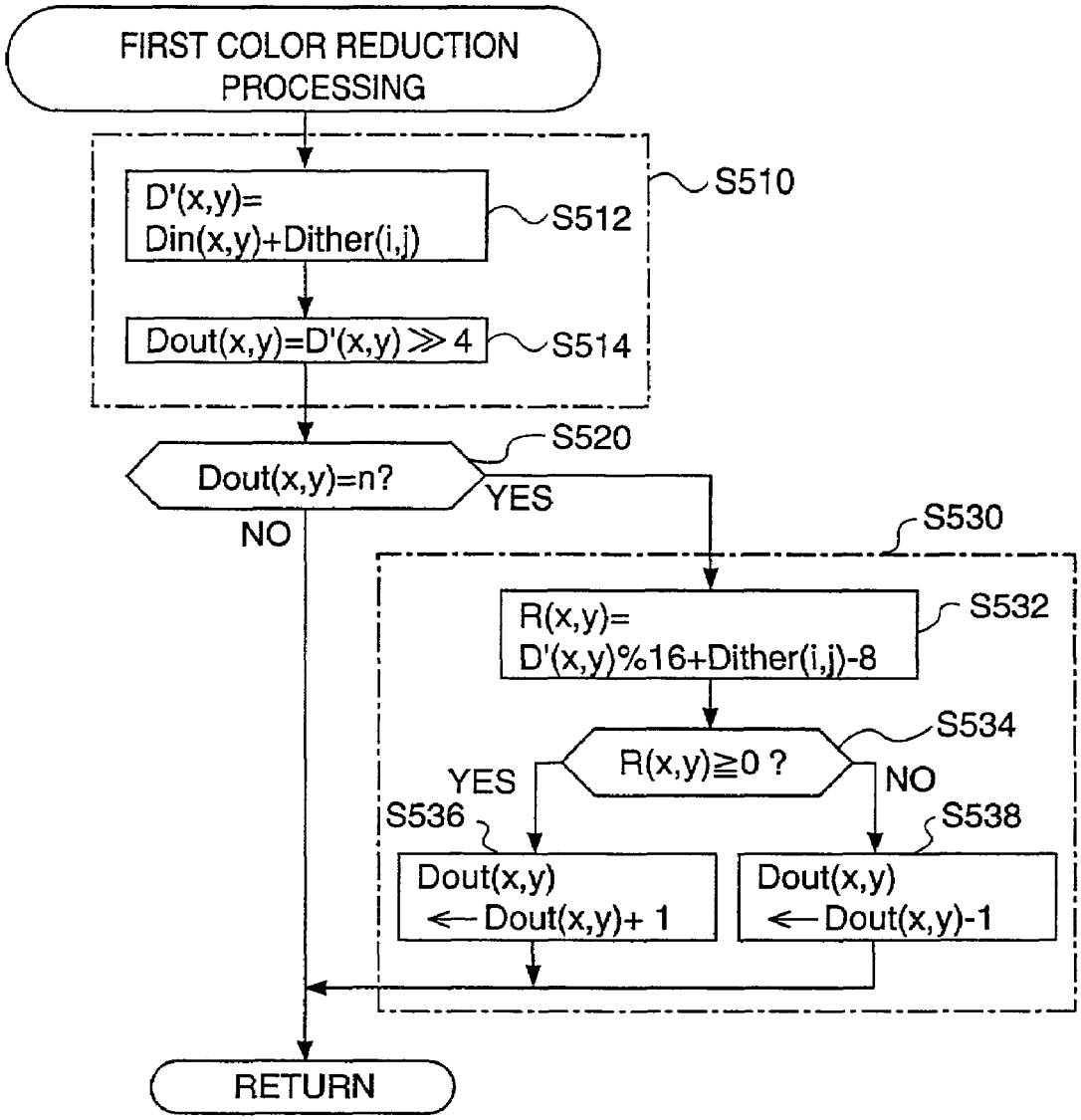
FIG. 16 is a flowchart illustrating the essential portion of image processing according to a second embodiment of the present invention.

FIG. 16 is a flowchart illustrating the content of the color reduction processing, which is the essential portion of the image processing according to the second embodiment.

Among the image data to be determined as a natural image, for providing some fluctuation, a dither value Dither (i,j) is added to data Din(x,y) indicating the grayscale of a designated pixel, and the added value is set to be D'(x,y) (step S512). The data Din(x,y) indicates the grayscale of the designated pixel at coordinates (x,y), and the dither value Dither(i, j) represents the value at the i-th row and j-th column of the dither matrix.

In this embodiment, it is assumed that the 256 levels are reduced to 16 levels. Thus, a 4×4-matrix, such as that shown in FIG. 17, may be used for the dither matrix.

The dither matrix of the first embodiment is used as the threshold values for comparison. In the second embodiment, however, the dither matrix is used as dither values for providing fluctuation to the grayscale value. Thus, it should be noted that the nature of the dither matrix of the second embodiment is slightly different from that of the first embodiment.

The left top corner of the image indicated by the image data is set to be standard coordinates (0,0). The positive sign of the X coordinates is defined to be on the right side, while the positive sign of the Y coordinates is defined to be on the lower side. Then, the arrangement i,j of the dither value corresponding to the designated pixel at the coordinates (x,y) is defined as the remainder obtained by dividing each of x, y by [4]. For example, if the coordinates of the designated pixel are (7,9), i and j are determined to be [3] and [1], respectively. Accordingly, [−2] at the first row and the third column is applied as the dither value. It should be noted that the pixel having the coordinates (7,9) are the eighth pixel counting from the left, such as 1, 2, 3, . . . , and the tenth pixel counting from the top, since the standard coordinates are set to be (0,0).

Then, the data D'(x,y) obtained by adding the dither value Dither(i,j) to the data Din(x,y) is binarized, and is then shifted to the right by four bits. The resulting value is provisionally set to be data Dout(x,y) (step S514). The data D'(x,y) is shifted to the right by four bits, which means that the data D'(x,y) is substantially divided by [16] (decimal notation). This also means that the 256 levels are converted into 16 levels.

Accordingly, in steps S512 and S514, after adding the dither value Dither(i,j) to the original data Din(x,y), the pseudo-halftone processing is performed in which the 256 levels are converted into 16 levels. This pseudo-halftone processing is frequently referred to in the following description, and thus, steps S512 and S514 are integrated into step S510.

It is then determined whether the grayscale data Dout(x, y), which has been subjected to the pseudo-halftone processing, is equal to the grayscale value [n] which may cause a defect, i.e., the grayscale data CDX read in step S130 (step S520).

If the grayscale data Dout(x,y) is not equal to the grayscale value [n], it is output as the converted value.

In contrast, if the grayscale data Dout(x,y) is equal to the grayscale value [n], second pseudo-halftone processing, which is integrated into S530, is executed. According to this second pseudo-halftone processing, the grayscale data is converted into one of the grayscale values adjacent to the grayscale value [n] by taking into consideration the information contained in the grayscale data before being converted.

First, the same dither value Dither(i,j) is added to the remainder obtained by dividing the above-described data D'(x,y) with 16, and then, [−8] is added to the added value. The resulting value is then set to be data R(x,y) (step S532). It is then determined whether the data R(x,y) is greater than or equal to [0] (step S534). That is, it is determined whether the value obtained by adding the dither value Dither(i, j) to the data D'(x,y), which may be converted into the grayscale value [n] causing a defect in the pseudo-halftone processing in step S510, is closer to the upper value of the two values adjacent to the grayscale value [n].

If this determination result is yes, the provisional data Dout(x,y) is incremented by [1] (step S536). Then, the incremented grayscale data Dout(x,y) is output as the converted value.

If, on the other hand, the determination result is no, the provisional data Dout(x,y) is decremented by [1] (step S538). Then, the decremented grayscale data Dout(x,y) is output as the converted value.

In this embodiment, only one pixel is designated, and the conversion process of the grayscale value of the designated pixel has been described. In reality, however, all the R, G, and B pixels are converted. Additionally, if there is any color which does not cause a defect in the displayed image, only the first pseudo-halftone processing in step S510 is performed on such a color.

The above-described image processing is described with reference to a specific example.

It is now assumed that the grayscale value is converted from the 256 levels to the 16 levels other than the grayscale value [5]. In this case, the grayscale value corresponding to the center of the grayscale value [5] is [88]. Thus, the conversion process for the data of the grayscale value [88] is discussed below.

When the dither values from [−8] to [7] are added to the grayscale value [88] (step S510), it is distributed in a range from [80] to [95]. This range is from 01010000 to 01011111 in binary notation, and the upper four bits are indicated by [5] in decimal notation. Thus, the second pseudo-halftone processing in step S530 is inevitably executed.

The range from [80] to [95] is equivalent to the range from [0] to [15], which are remainders obtained by dividing the first range by 16. After adding the same dither values [−8] to [7] as those in step S512 to the remainders, [−8] is added. Then, the resulting values are distributed as a range [−16], [−14], . . . , [−2], [0], . . . , [12], [14]. In this range, the values from [−16] to [−2] are converted to the grayscale data having the grayscale value [4] (step S538). The values from [0] to [14] are converted into the grayscale data having the grayscale value [6] (step S536). Consequently, the data having the grayscale value [88] in the 256 levels is converted into the grayscale value [4] or [6] in the 16 levels with 50% probability each.

The same applies to the data adjacent to the grayscale value [88] in the 256 levels. It is also converted into the grayscale value [4] or [6] in the 16 levels according to the grayscale value of this data.

Accordingly, in the second embodiment, it is possible to prevent the conversion into a grayscale value which may cause a defect, and also, the grayscale of such a grayscale value can be expressed by using one of the adjacent grayscale values as pseudo-values. Thus, the overall balance of the grayscale characteristics is not disturbed.

Additionally, in the above-described second embodiment, if the determination result in step S520 is yes, the second pseudo-halftone processing is executed. In this case, since the same dither matrix is used, the area for storing the dither matrix is not increased, or the pseudo-halftone processing does not become complex. Instead of using the same dither matrix, a dither matrix obtained by adding [−8] to each dither value of the dither matrix used in step S512 may be prepared separately. If the two dither matrixes are prepared, the addition of [−8] in step S532 can be omitted.

Figure 18A:
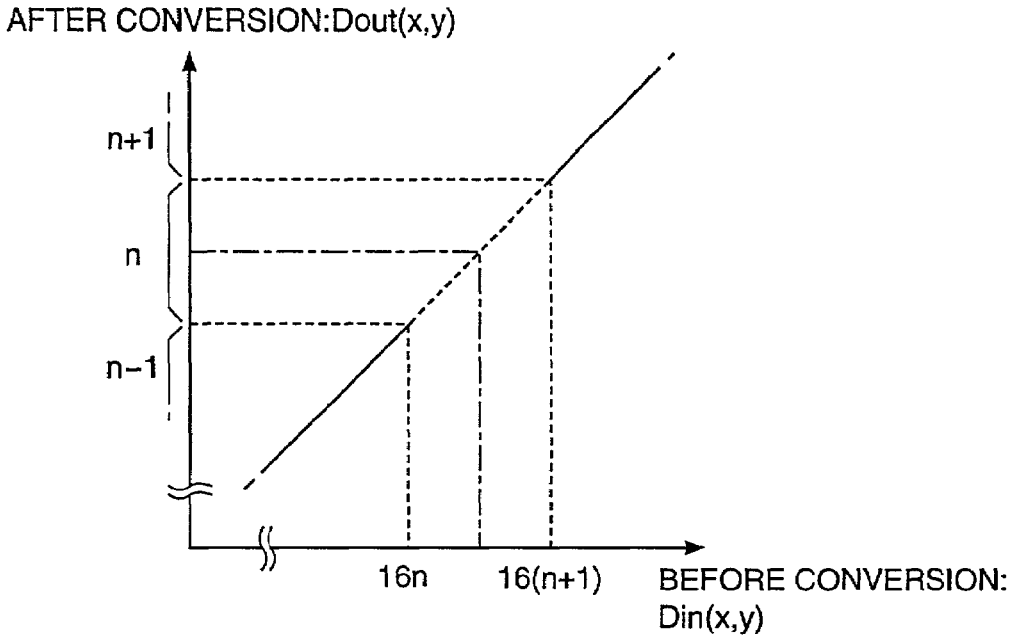
FIGS. 18A and 18B each illustrate the input/output relationship in the same image processing.

In the above-described second embodiment, after performing the first pseudo-halftone processing (step S510), it is determined whether the grayscale data Dout(x,y) is a grayscale value which may cause a defect in the displayed image (step S520). Then, only when this determination result is yes, the second pseudo-halftone processing (step S530) is executed in which the grayscale data is converted into one of the adjacent grayscale values. This processing is discussed below with reference to FIG. 18A. The second pseudo-halftone processing is executed only when the grayscale values reduced by the first pseudo-halftone processing results in a range of the grayscale value [n] which may cause a defect (indicated by the broken line in FIG. 18A). The second pseudo-halftone processing is not performed in the other ranges (indicated by the solid lines of FIG. 18A), and the grayscale data obtained by the first pseudo-halftone processing is directly output.

According to the second embodiment, the grayscale value [n] which may cause a defect can be completely eliminated. However, as in the applied examples of the first embodiment, simply by decreasing the frequency of occurrence of the grayscale value [n], the decrease in the image quality can be made negligible.

In order to reduce the frequency of occurrence of the grayscale value [n] in the second embodiment, the determination process in step S520 may be changed as follows.

Figure 18B:
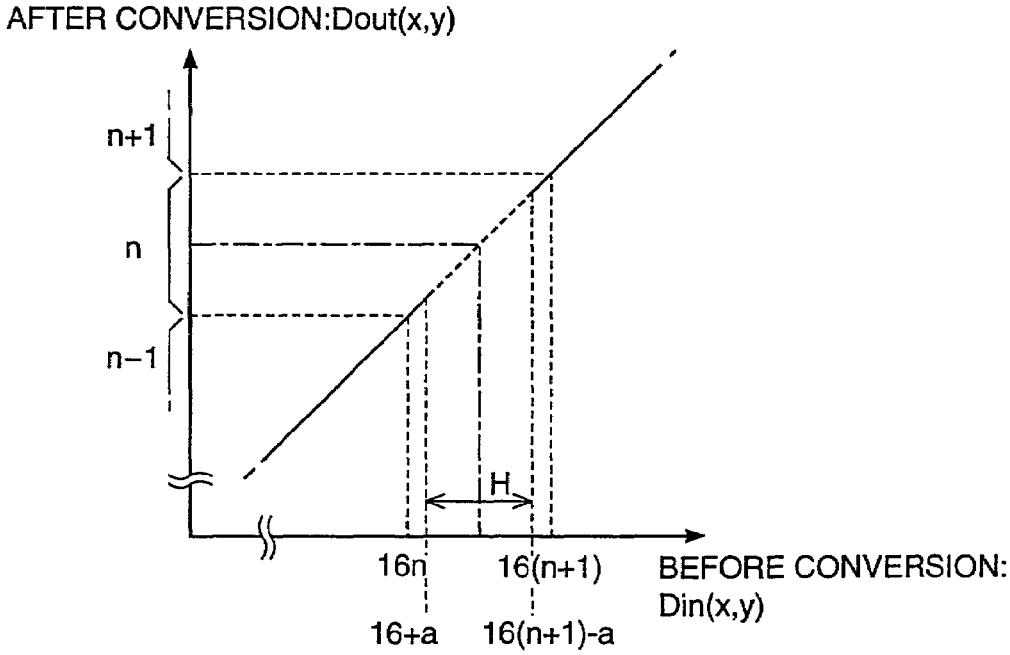

That is, it is determined whether the provisional grayscale data Dout(x,y) after being reduced is equal to the grayscale value [n] which may cause a defect, and it is also determined whether the grayscale value of the input data Din(x,y) is included in a range H from [16n+a] to smaller than [16(n+1)−a]. In this case, as shown in FIG. 18B, the range H is narrower than the range corresponding to the grayscale value [n] in the 16 levels, and [a] is a positive value and indicates a margin (or redundancy).

When the first pseudo-halftone processing (step S510) is performed on the data Din(x,y) whose grayscale value is in a range from [16n] to smaller than [16n+a], the resulting grayscale value becomes [n−1] or [n]. However, according to the modified step S520, the determination result is no. Thus, the grayscale value [n] may be output.

Similarly, when the first pseudo-halftone processing (step S510) is performed on the data Din(x,y) whose grayscale value is in a range from [16(n+1)−a] to smaller than [16(n+1)], the resulting grayscale value becomes [n] or [n+1]. However, according to the modified step S520, the determination result is no. Accordingly, the grayscale value [n] may be output.

However, only in the above-described two cases, the determination result of the modified step S520 becomes no, and the grayscale value [n] is output. When the first pseudo-halftone processing (step S510) is performed on the data Din(x,y) which falls in the range H, and when the provisional grayscale value becomes [n], the determination result of the modified step S520 is yes. Accordingly, the second pseudo-halftone processing is performed (step S530), and the resulting grayscale value becomes [n−1] or [n+1].

Consequently, if the determination process in step S520 is modified, the frequency of the output of the grayscale value [n] is reduced, though the grayscale value [n] is sometimes output.

If the frequency of the output of the grayscale value [n] becomes high by modifying the step S520, the margin [a] is set to a smaller value, in which case, the range H is increased, thereby reducing the frequency of the output of the grayscale value [n].

Accordingly, the determination process in step S520 is modified, and also, the margin [a] is set to a suitable value. Then, the overall balance of the halftone characteristics can be maintained without impairing the display quality.

In the above-described second embodiment, after the first pseudo-halftone processing (step S510), it is determined whether the processed grayscale data Dout(x,y) is equal to a grayscale value which may cause a defect in the displayed image (step S520). Only when this determination result is yes, the second pseudo-halftone processing (step S530) is executed in which the grayscale data is converted into one of the adjacent grayscale values.

The following process may be employed so as to obtain a result comparable to the above-described result. The two types of pseudo-halftone processing may be prepared, and according to the determination result of the grayscale value of the input data Din(x,y), one of the two types of pseudo-halftone processing may be executed.

Thus, a third embodiment using such a process is described below. The image processing according to the third embodiment is similar to that of FIG. 3, except for step S150, and an explanation of the identical steps will thus be omitted. For further simple representation, an explanation of a recursive process for performing the processing on all the pixels and a process for presetting or clearing the required values will also be omitted. Also, in the third embodiment, as in the second embodiment, it is assumed that 256 levels are reduced to 16 levels.

Figure 19:
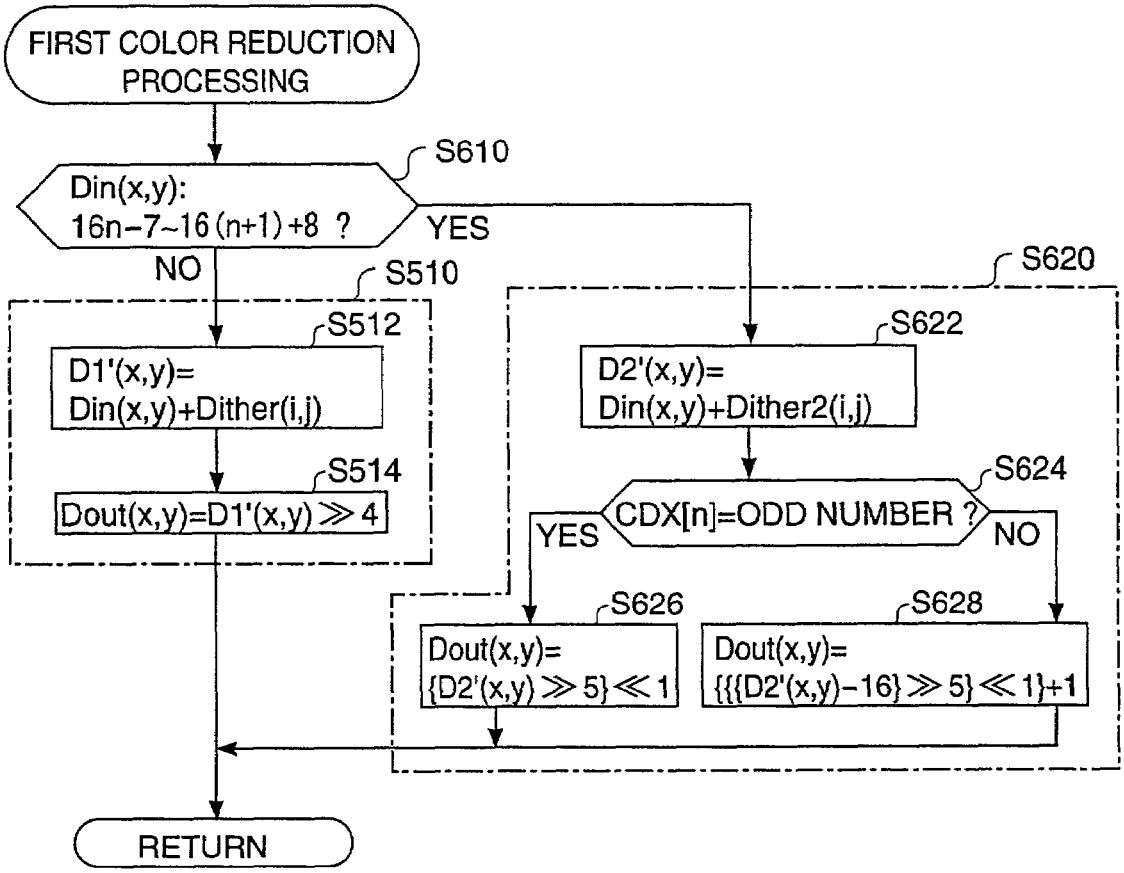
FIG. 19 is a flowchart illustrating the essential portion of image processing according to a third embodiment of the present invention.

FIG. 19 is a flowchart illustrating the color reduction processing, which is the essential portion of the image processing according to the third embodiment.

Among the image data determined to be a natural image, it is determined whether the grayscale value of the data Din(x,y) of a designated pixel is in a range which may be converted into the grayscale value [n] causing a defect as a result of the execution of pseudo-halftone processing (A) (step S610).

Figure 21A:
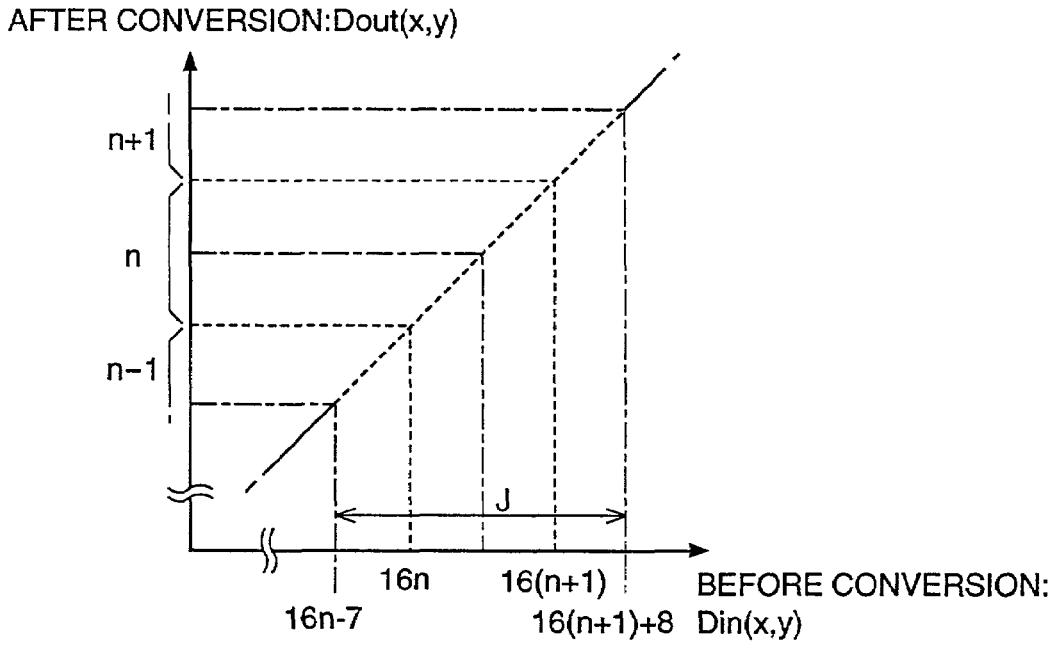
FIGS. 21A and 21B each illustrate the relationship of the input/output ranges in the same image processing.
Figure 21B:
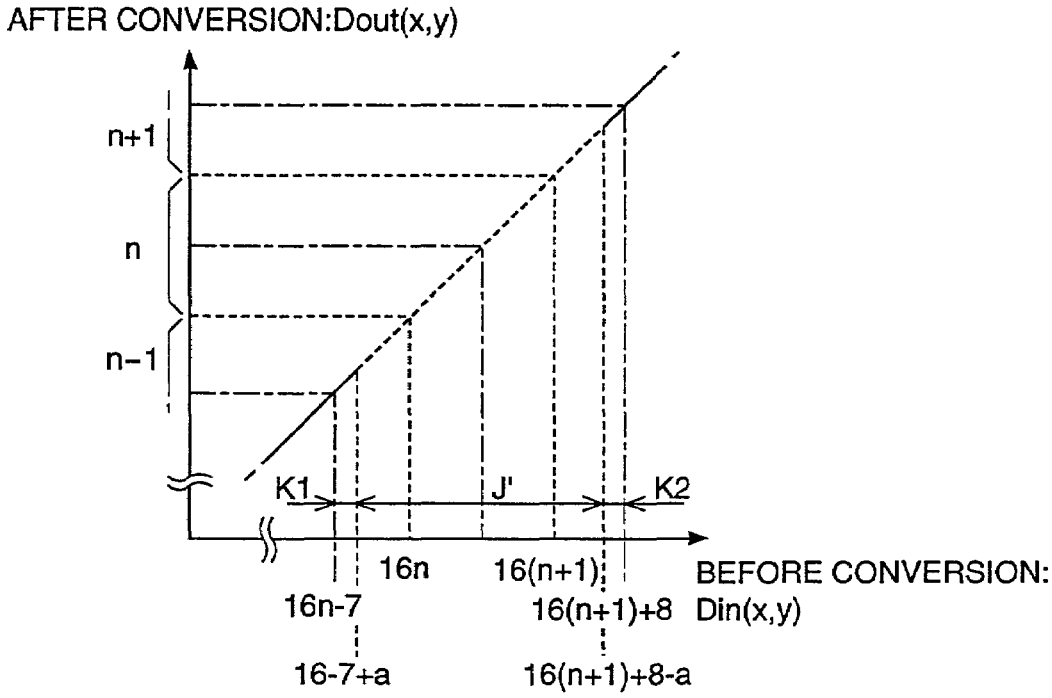

The grayscale value [n] in the 16 levels is, as shown in FIG. 21A, equivalent to a range from [16n] to smaller than [16(n+1)] in the 256 levels. It is now assumed that the pseudo-halftone processing (A) in this embodiment is similar to the first pseudo-halftone processing in the second embodiment. Then, among the dither values of the dither matrix shown in FIG. 17, the maximum value is [+7], and the minimum value is [−8]. Accordingly, if the grayscale value is in a range J from [16n−7] to smaller than [16(n+1)+8], it may be converted into the grayscale value [n] by executing the pseudo-halftone processing (A). That is, in step S610, it is determined whether the grayscale value of the data Din(x,y) ranges from [16n−7] to smaller than [16(n+1)+8].

If the grayscale value of the data Din(x,y) is not in the range J, there is no possibility of converting the grayscale value into the grayscale value [n] by executing the pseudo-halftone processing (A). Accordingly, the pseudo-halftone processing (A) is executed in step S510, and the processed result is output. The pseudo-halftone processing (A) is the same as the first pseudo-halftone processing in the second embodiment, and an explanation thereof will thus be omitted.

In contrast, if the grayscale value of the data Din(x,y) is in the range J, there is a possibility of converting the grayscale value into the grayscale value [n] by performing the pseudo-halftone processing (A). Thus, in order to eliminate this possibility, pseudo-halftone processing (B) is executed (step S620).

In this pseudo-halftone processing (B), a dither value Dither2(i,j) is first added to the data Din(x,y), and the added value is set to be D2'(x,y) (step S622).

Then, it is determined whether the grayscale value [n] which may cause a defect is an odd value (step S624).

If the grayscale value [n] is an odd value, the data D2'(x,y) is binarized, and is shifted to the right by five bits and then to the left by one bit. The resulting value is set to be grayscale data Dout(x,y) (step S626).

Conversely, if the grayscale value [n] is an even value, [16] is subtracted from the data D2'(x,y), and is then binarized. The binary data is then shifted to the right by five bits and to the left by one bit. The resulting value is then incremented by [1], and the incremented value is set to be grayscale data Dout(x,y) (step S628).

Details of the processing in the pseudo-halftone processing (B) are given below. This pseudo-halftone processing (B) is processing for converting the grayscale data Din(x,y) defined by the 256 levels into the adjacent value [n−1] or [n+1] rather than the original grayscale value [n] in the 16 levels.

From another point of view, this processing is substantially equal to the following processing. It is now assumed that the 256-level data Din(x,y) is converted into 8-level data by adding the dither value thereto. Then, it is found which grayscale value in the 16 levels corresponds to the 8-level value.

In this processing, when determining which 16-level grayscale value corresponds to the 8-level grayscale value, it is necessary to consider whether the grayscale value [n] which may cause a defect is an odd number or an even number. That is, when the grayscale value [n] is an odd number, it is converted into an even-numbered grayscale value [n−1] or [n+1]. When the grayscale value [n] is an even number, it is converted into an odd-numbered grayscale value [n−1] or [n+1].

Figure 22:
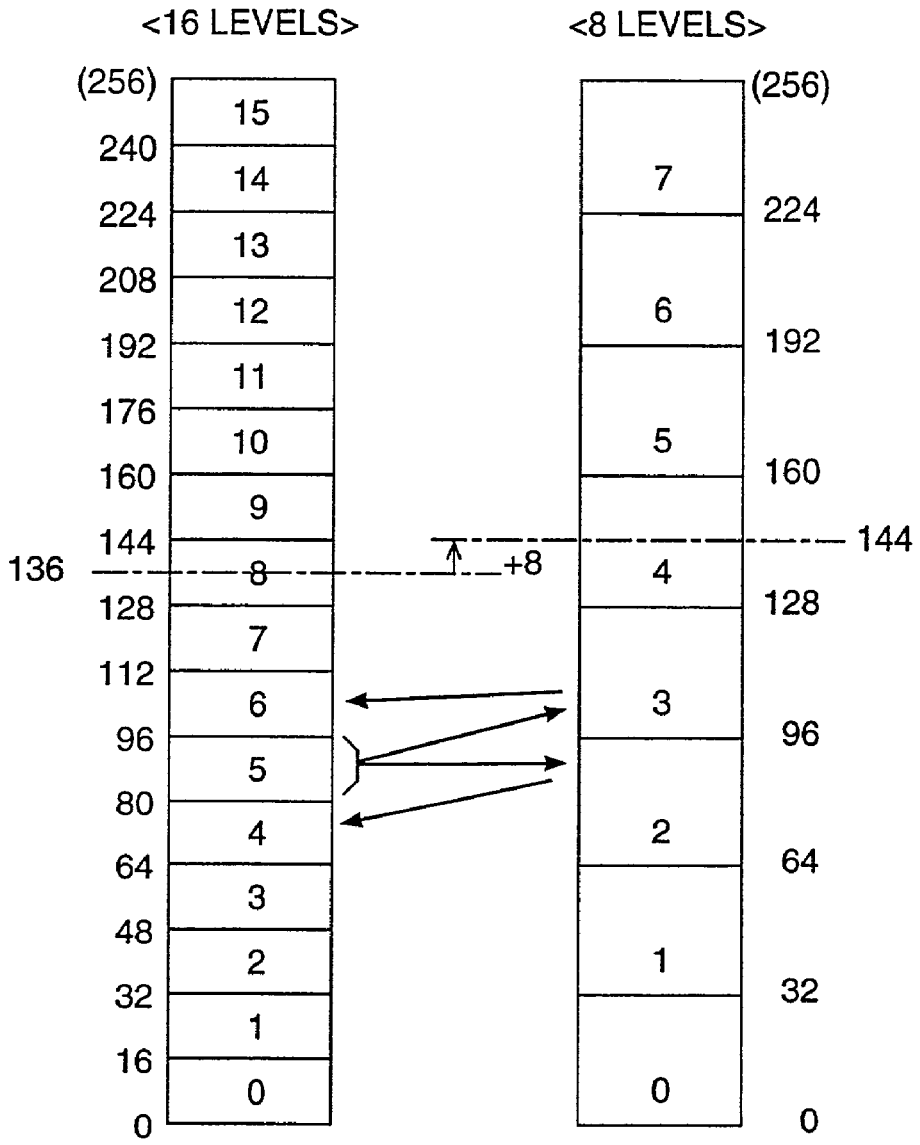
FIG. 22 is a diagram illustrating the reason for which the elements in the same dither matrix are used.

For example, it is now assumed that the grayscale value [n] which may cause a defect is an odd number [5]. In this case, as shown in FIG. 22, when a dither value for converting the grayscale values into the 8-level values is added to the data ranging from [80] to smaller than [96] in the 256 levels, the added value is distributed into a range corresponding to the grayscale values [2] and [3] in the 8 levels. If the added value is in the range corresponding to the grayscale value [2], it is converted into the grayscale value [4] in the 16 levels. If the added value is in the range corresponding to the grayscale value [3], it is converted into the grayscale value [6] in the 16 levels.

On the other hand, it is assumed that the grayscale value [n] which may cause a defect is an even number, for example, [8]. In this case, when a dither value for converting the grayscale values into the 8 levels is added to the data ranging from [128] to smaller than [144] in the 256 levels, the added value is distributed into the range corresponding to the grayscale values [3] and [4] in the 8 levels (in practice, the added value is not distributed to the above-described range since the dither matrix shown in FIG. 20 is used. However, it may be safely considered that the added value is apparently distributed to the above-described range since [16] is subtracted from the added value in step S628). If the added value is in the range corresponding to the grayscale value [3], it is converted into the grayscale value [7] in the 16 levels. If the added value is in the range corresponding to the grayscale value [4], it is converted into the grayscale value [9] in the 16 levels.

For simply converting the 256 levels into the 8 levels, the dither value of the dither matrix should be doubled. However, between the 8-level conversion and the 16-level conversion, it is necessary to consider a displacement between the center of the 8 levels and that of the 16 levels.

For example, as shown in FIG. 22, the center of the grayscale value [8] in the 16 levels corresponds to the grayscale value [136] in the 256 levels, while the center of the grayscale value [4] in the 8 levels corresponds to the grayscale value [144] in the 256 levels. Accordingly, there is a difference of [8].

Thus, when the dither value used in the 16-level conversion is used for the 8-level conversion, the dither value is first doubled, and then, [8] should be added. The dither matrix used in the pseudo-halftone processing (B) is the one shown in FIG. 20, and the dither value Dither2(x,y) is equal to the value obtained by doubling the dither value Dither(x, y) of the dither matrix shown in FIG. 17 and by adding [8] to the doubled value.

That is, step S622 is processing in which the dither value Dither2(x,y) for subtracting the 256 levels to the 8 levels is added to the data Din(x,y) so as to obtain D2'(x,y).

If the grayscale value [n] which may cause a defect is an odd number, the 256-level data D2'(x,y) is converted into an even-numbered grayscale value [n−1] or [n+1] in the 16 levels. According to this conversion, the data D2'(x,y) is first binarized. Then, the higher three bits are extracted, and the lowest bit is forcibly set to (0). Step S626 indicates the above-described conversion.

If the grayscale value [n] which may cause a defect is an even number, the 256-level data D2'(x,y) is converted into an odd-numbered grayscale value [n−1] or [n+1] in the 16 levels. According to this conversion, the data D2'(x,y) is first binarized. Then, the higher three bits are extracted, and the lowest bit is forcibly set to (1). Step S628 indicates the above-described conversion.

As described above, in the third embodiment, if there is no possibility of converting the grayscale value of the data Din(x,y) of the designated pixel into the grayscale value [n] which may cause a defect as a result of executing the pseudo-halftone processing (A), the pseudo-halftone processing (A) is executed, and the processed result is output. On the other hand, if there is a possibility of converting the grayscale value of the data Din(x,y) of the designated pixel into the grayscale value [n] which may cause a defect as a result of executing the pseudo-halftone processing (A), the pseudo-halftone processing (B) is executed, and the grayscale value [n−1] or [n+1] is output.

Thus, according to the third embodiment, as in the second embodiment, the conversion into the grayscale value which may cause a defect can be prevented, and also, the grayscales of the grayscale value which may cause a defect and the grayscale values around such a grayscale value can be expressed as pseudo-values by using the adjacent grayscale values. As a result, the overall balance of the halftone grayscale characteristics is not disturbed.

In the above-described third embodiment, the dither matrix used in step S512 (see FIG. 17) can be different from the dither matrix used in step S622 (see FIG. 20). As discussed above, however, the dither value Dither2(x,y) is equal to the value obtained by doubling the dither value Dither(x,y) and by adding [8]. Thus, one dither matrix can be determined by the other dither matrix by computation. Accordingly, the number of dither matrixes required in the third embodiment is one, and thus, the area for storing the dither matrix is not increased, and the configuration for the pseudo-halftone processing does not become complex.

In step S628, [16] is subtracted from the data D2'(x,y). Alternatively, a dither matrix obtained by subtracting [16] from each dither value of the dither matrix used in step S622 may separately be prepared.

In the foregoing third embodiment, the possibility of converting the grayscale data into the grayscale value [n] which may cause a defect during the color reduction processing is completely eliminated. That is, the grayscale value [n] is not output. However, as in the applied example of the second embodiment, the third embodiment may be modified to decrease the frequency of occurrence of the grayscale value [n]. If the probability of occurrence of the conversion into the grayscale value [n] is small, the decrease in the image quality can be made negligible.

In the third embodiment, in order to decrease the frequency of occurrence of the grayscale value [n], the range J which renders the determination result of step S610 to be yes should be made narrower, as in the second embodiment. More specifically, only when the grayscale value of the input data Din(x,y) falls in a range J' from [16n−7+a] to smaller than [16(n+1)+8−a], the pseudo-halftone processing (B) is executed.

By modifying the determination content in step S610, as discussed above, when the grayscale value of the data Din(x,y) falls in a range K1 from [16n−7] to smaller than [16n−7+a], the pseudo-halftone processing (A) in step S510 is executed. Thus, according to the dither value Dither(i,j) added in step S512, the grayscale value [n] may be output (according to the dither value Dither(i,j), the grayscale value [n] may not be output).

Similarly, when the grayscale value of the data Din(x,y) falls in a range K2 from [16(n+1)+8−a] to smaller than [16(n+1)+8], the pseudo-halftone processing (A) in step S510 is executed. Thus, according to the dither value Dither (i,j) to be added, the grayscale value [n] may be output.

However, the grayscale value [n] is output only when the grayscale value of the data Din(x,y) falls in the range K1 or K2, and when the data D'(x,y) is in the range from [16n] to smaller than [16(n+1)] after the dither value Dither[i,j] is added thereto. Accordingly, the probability of occurrence of the output of the grayscale value [n] is small. Additionally, as in the applied example of the second embodiment, the probability of occurrence of the grayscale value [n] may be adjusted by the margin [a].

In the third embodiment, too, therefore, by modifying the determination content in step S610, and by suitably setting the margin [a], the overall balance of the halftone characteristics can be maintained without impairing the display quality.

In the second embodiment, the first pseudo-halftone processing is performed without determining the grayscale value of the input data Din(x,y). Then, only when the result of the first pseudo-halftone processing is the grayscale value [a] which may cause a defect, the second pseudo-halftone processing is executed. The relationship between the dither value used in the second pseudo-halftone processing and that in the first pseudo-halftone processing is that the former dither value substantially offsets the latter dither value.

The execution of the first and second pseudo-halftone processing is substantially equivalent to that of the pseudo-halftone processing (B) of the second embodiment, i.e., it means that the doubled dither value is added. After all, the second embodiment and the third embodiment are different merely in the process of the pseudo-halftone processing, and the algorithms are the same. In practice, the result of the second embodiment and that of the third embodiment are the same.

In the second embodiment, the number of times the dither value is added is greater than that of the third embodiment. In the second embodiment, however, it is not necessary to determine whether the grayscale value [n] is an odd number or an even number. Accordingly, a determination may be made as to whether to use the second embodiment or the third embodiment, considering the various conditions.

According to the above-described second and third embodiments, the conversion into the grayscale value which may cause a defect can be prevented, and the balance of the halftone characteristics is not disturbed. However, in the second embodiment, it is necessary to determine the processed data Dout(x,y) (step S520) after executing the first pseudo-halftone processing. In the third embodiment, it is necessary to determine the input data Din(x,y) (step S610) before executing the pseudo-halftone processing (A) or (B). Accordingly, the time required for image processing may disadvantageously become longer.

Accordingly, a fourth embodiment is described below in which rapid processing can be expected while preventing the display of a grayscale value which may cause a defect in the displayed image and while ensuring the reproducibility of halftones. The image processing according to the fourth embodiment is similar to that shown in FIG. 2, except for step S150, and an explanation of the identical steps will thus be omitted. For further simple representation, an explanation of a recursive process for performing the processing on all the pixels, or a process for presetting or clearing the required values will also be omitted. In the fourth embodiment, as in the second and third embodiments, it is assumed that 256 levels are reduced into 16 levels.

An overview of the image processing according to the fourth embodiment is as follows. Firstly, a certain pre-processing is performed on the grayscale value of the input image data by using, for example, a look-up table. Secondly, pseudo-halftone processing is performed on the pre-processed data. Thirdly, a certain post-processing is performed on the grayscale value of the pseudo-halftone-processed data by using, for example, a look-up table. Then, the post-processed data is output.

Figures 23A, 23B:
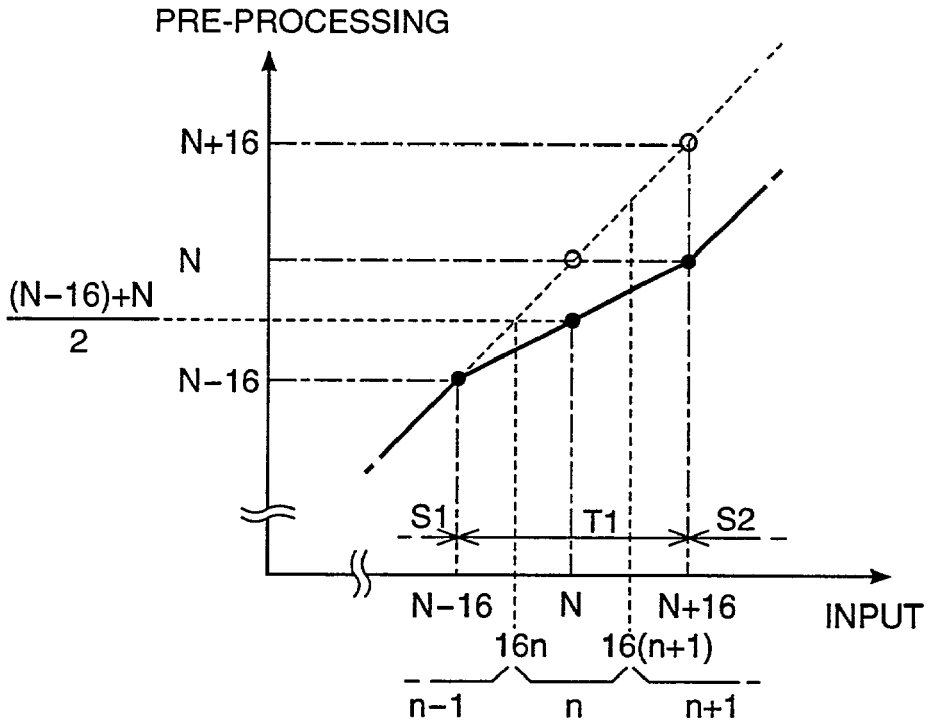
FIGS. 23A and 23B each illustrate the principle of image processing according to a fourth embodiment of the present invention.

The principle of the image processing according to the fourth embodiment is described below. FIG. 23A is a diagram illustrating the input/output characteristics of the above-described pre-processing. FIG. 23B is a table representing the relationships among the above-described pre-processing, the dither processing (pseudo-halftone processing), and the post-processing.

In these figures, the input grayscale value [N] corresponds to a range of the grayscale value [n] which may cause a defect in the 16 levels, and also indicates the center of the 256 levels. Accordingly, the input grayscale values [N—16] and [N+16] correspond to the ranges of the grayscale values [n−1] and [n+1], respectively, in the 16 levels, and indicate the center of the 256 levels.

As shown in FIG. 23A, according to the pre-processing, when the grayscale value of the input data falls in a range S1 smaller than [N−16], it is output as it is. When the grayscale value of the input data falls in a range T1 from [N−16] to smaller than [N+16], it is converted into a range from [N−16] to smaller than [N] with a halved inclination. When the grayscale value of the input data falls in a range S2 greater than or equal to [N+16], it is converted into a value obtained by subtracting [16] from the original value.

Thus, the grayscale value [N] indicating the center of the 256 levels corresponding to the range of the grayscale value [n] is converted, as shown in FIG. 23A or 23B, into the grayscale value [{(N−16)+N}/2] according to the above-described pre-processing.

Then, pseudo-halftone processing for reducing 256 levels into 16 levels is performed on the data converted by the pre-processing. This pseudo-halftone processing is similar to, for example, the first pseudo-halftone processing (step S510) of the second embodiment.

As shown in FIG. 23B, upon performing the pseudo-halftone processing on the grayscale value [N−16], it is converted into the corresponding grayscale value [n−1]. The reason is as follows. The grayscale value [N-16] in the 256 levels is the center value of the range corresponding to the grayscale value [n−1] in the 16 levels. Accordingly, the addition of any of the dither values Dither(i,j) from [−8] to [7] does not influence the conversion. Likewise, when the pseudo-halftone processing is performed on the pre-processed grayscale value [N], it is provisionally converted into the corresponding grayscale value [n].

However, if the pseudo-halftone processing is performed on the grayscale value [{(N−16)+N}/2], it is converted into the grayscale value [n−1] or [n] with 50% probability each. The reason is as follows. The grayscale value [{(N−16)+N}/2] is the intermediate value between the center value of the range corresponding to the 16-level grayscale value [n−1] and the center value of the range corresponding to the 16-level grayscale value [n], i.e., the boundary value between the range corresponding to the grayscale value [n] and the range corresponding to [n−1]. Thus, when a dither value smaller than [0] is added, the grayscale value [{(N−16)+N}/2] is converted into the grayscale value [n−1]. When a dither value greater than or equal to [0] is added, the grayscale value [{(N−16)+N}/2] is converted into the grayscale value [n].

The grayscale value [n] resulting from executing the pseudo-halftone processing is provisional.

In this case, the output of the grayscale value [n] must be prevented. Additionally, the grayscale value [n] or greater resulting by the execution of the pseudo-halftone processing is equivalent to the value obtained by subtracting [16] from the grayscale value in the range greater than or equal to [N+16] in the 256 levels. Thus, it is necessary to match the grayscale value [n] or greater to the original value.

Accordingly, the post-processing is performed as follows. When the grayscale value of the data output as a result of the pseudo-halftone processing is smaller than [n−1], it is output as it is. When the grayscale value of the data output as a result of the pseudo-halftone processing is [n] or greater, it is incremented by [1].

That is, according to the post-processing, when the pseudo-halftone processed grayscale value is [n−1] or smaller, it is output as it is. When the pseudo-halftone processed provisional grayscale value is [n] or greater, it is incremented by [1], and the incremented value is output.

Accordingly, the output of the grayscale value [n] which may cause a defect can be prevented.

Figure 24:
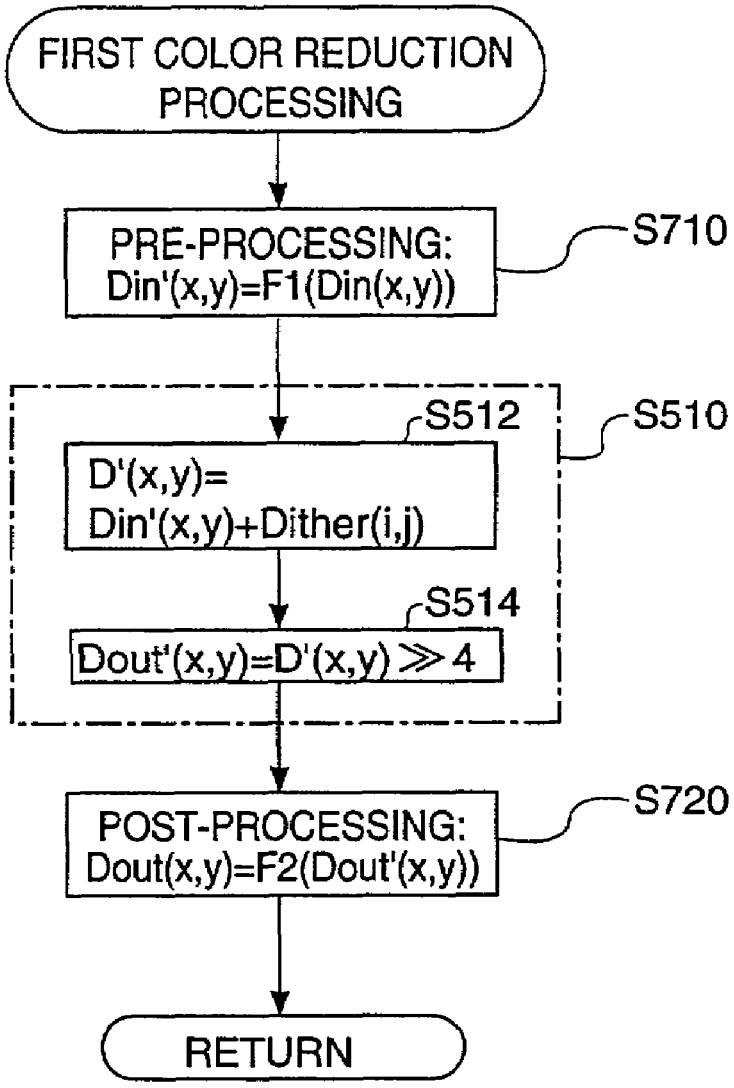
FIG. 24 is a flowchart illustrating the essential portion of the same image processing.

The image processing performed based on this principle is discussed below through illustration of a specific example. FIG. 24 is a flowchart illustrating the content of the image processing.

Among the image data determined to be a natural image, the data Din(x,y) of the designated pixel is converted according to the above-described pre-processing, resulting in the data Din'(x,y) (step S710). That is, in step S710 of FIG. 24, the conversion of the pre-processing is represented by a function F1 using the data Din(x,y) as an input.

Figure 25:
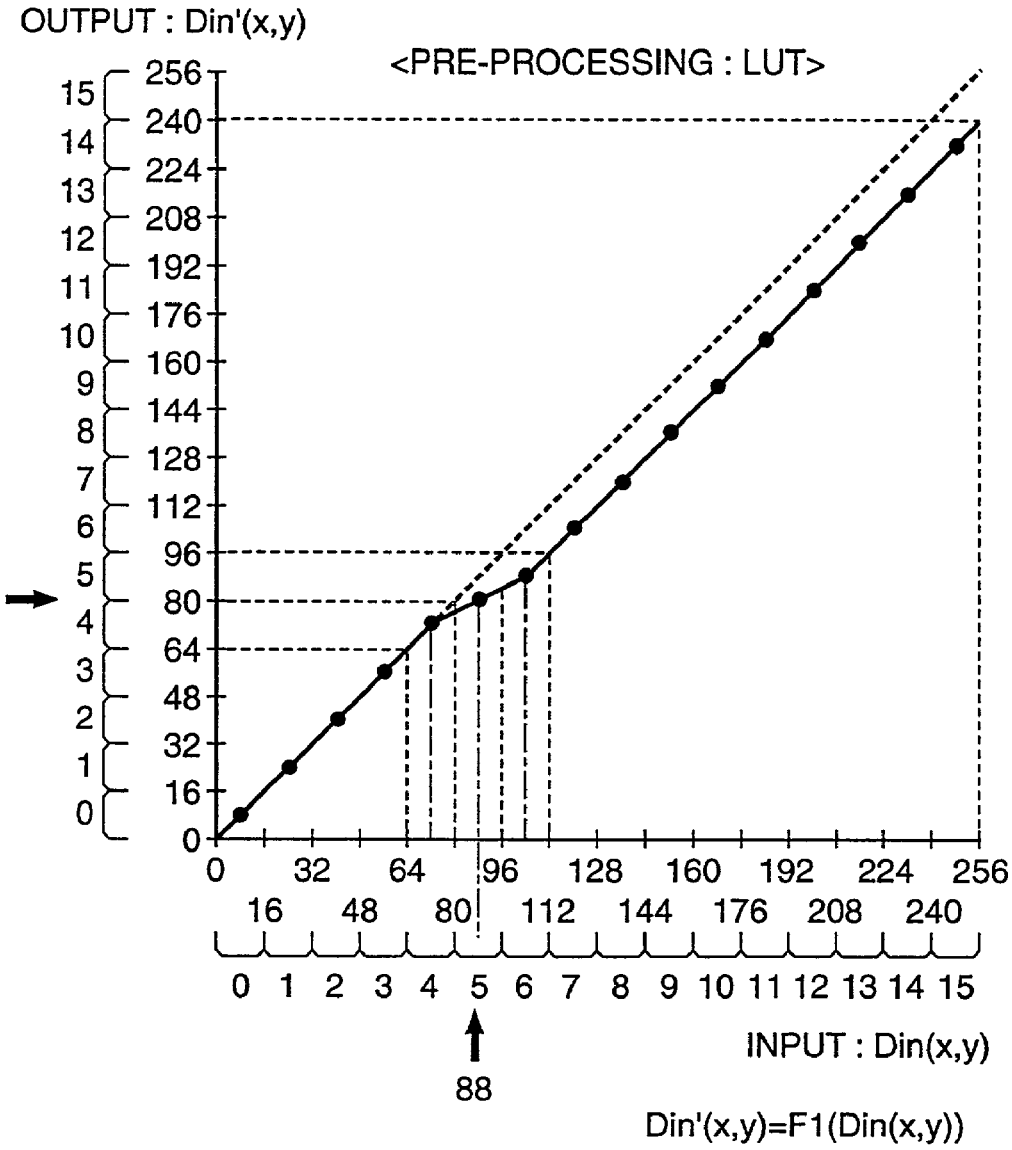
FIG. 25 is a diagram illustrating the conversion content of pre-processing in the same image processing.

Any technique for implementing such a conversion may be employed as long as it satisfies the content of the above-described pre-processing. For example, the conversion of the above-described pre-processing may be implemented as follows. It is determined in which range S1, T1, or S2 shown in FIG. 23A the grayscale value of the data Din(x,y) is contained, and then, according to the determination result, the value is determined by computation. Alternatively, after reading the data indicating the grayscale value [n] which may cause a defect, a look-up table in which the relationship between the 256-level grayscale values and the corresponding converted values is defined may be stored in the RAM 34, and the value corresponding to the input data Din(x,y) may be output. With this arrangement, too, the conversion of the above-described pre-processing can be implemented. When the look-up table is used, the input/output characteristics of the look-up table are indicated by, for example, those shown in FIG. 25 if the grayscale value which may cause a defect is [5].

Then, the pseudo-halftone processing is performed on the pre-processed data Din'(x,y), and the processed data is provisionally output as the data Dout'(x,y) (step S510). This pseudo-halftone processing is similar to the first pseudo-halftone processing of the second embodiment.

Then, the pseudo-halftone processed data Dout'(x,y) is converted by the above-described post-processing, and is output as the data Dout(x,y) (step S720). In step S720 of FIG. 24, the conversion of the post-processing is indicated by a function F2 using the data Dout'(x,y) as an input.

Any technique for implementing such a conversion may be employed as long as it satisfies the content of the post-processing. For example, the conversion of the post-processing may be implemented as follows. It is determined whether the data Dout'(x,y) is the grayscale value [n] or greater. If the determination result is no, the data Dout'(x,y) is output as the data Dout(x,y). If the determination result is yes, the data Dout'(x,y) is incremented by [1], and the incremented value is output as the data Dout(x,y). Alternatively, after reading the data indicating the grayscale value [n] which may cause a defect, a look-up table in which the relationships between the 16-level grayscale values and the corresponding converted values are defined is stored in the RAM 34, and the value corresponding to the input data Dout'(x,y) is output. With this arrangement, too, the conversion of the above-described post-processing can be achieved. When the look-up table is used, the input/output characteristics of the look-up table are indicated by, for example, those shown in FIG. 26 if the grayscale value which may cause a defect is [5].

According to the above-described image processing, when reducing 256 levels into 16 levels, the 256-level grayscale value [88] corresponding to the center of the grayscale value [5] (see FIG. 25) can be converted into the grayscale value [80] by the pre-processing in step S710, assuming that the grayscale value which must be prevented is [5].

In the pseudo-halftone processing in step S510, among the dither values [−8] to [7] and for the grayscale value [80], if a value smaller than [0] is added, the grayscale value is converted into the grayscale value [4] in the 16 levels. If a value greater than or equal to [0] is added, the grayscale value is converted into the grayscale value [5] in the 16 levels. Accordingly, the data of the grayscale value [88] in the 256 levels is converted into the grayscale value [4] or [5] in the 16 levels with 50% probability each.

However, the grayscale value [5] is incremented to [6] by the post-processing in step S720. Thus, as in the second embodiment, the 256-level grayscale value [88] is converted into the 16-level grayscale value [4] or [6] with 50% probability.

The same may be applied to the data close to the grayscale value [88]. Such data is converted into the 16-level grayscale value [4] or [6] with the probability according to the grayscale value of the data.

Thus, according to the fourth embodiment, the conversion into the grayscale value which may cause a defect can be prevented. Also, the grayscales of the grayscale value which may cause a defect and the grayscale values around such a grayscale value can be expressed as pseudo-values by using the adjacent grayscale values. As a result, the overall balance of the halftone grayscale characteristics is not disturbed.

Additionally, according to the fourth embodiment, only the pre-processing and the post-processing are required, except for the pseudo-halftone processing, and as discussed above, only the look-up table (or simple computation) is required for implementing each of the pre-processing and the post-processing. Thus, faster processing can be performed in comparison with the second and third embodiments.

In the above-described third embodiment, the possibility of conversion into the grayscale value [n] which may cause a defect during the color reduction processing is completely eliminated. However, as in the applied examples of the second and third embodiments, simply by reducing the frequency of occurrence of the grayscale value [n], the decrease in the image quality can be made negligible.

In the fourth embodiment, in order to reduce the frequency of occurrence of the grayscale value [n], three types of conversions according to the post-processing are prepared, and one of the three types is applied according to the value of the input data Din(x,y).

Figure 27:
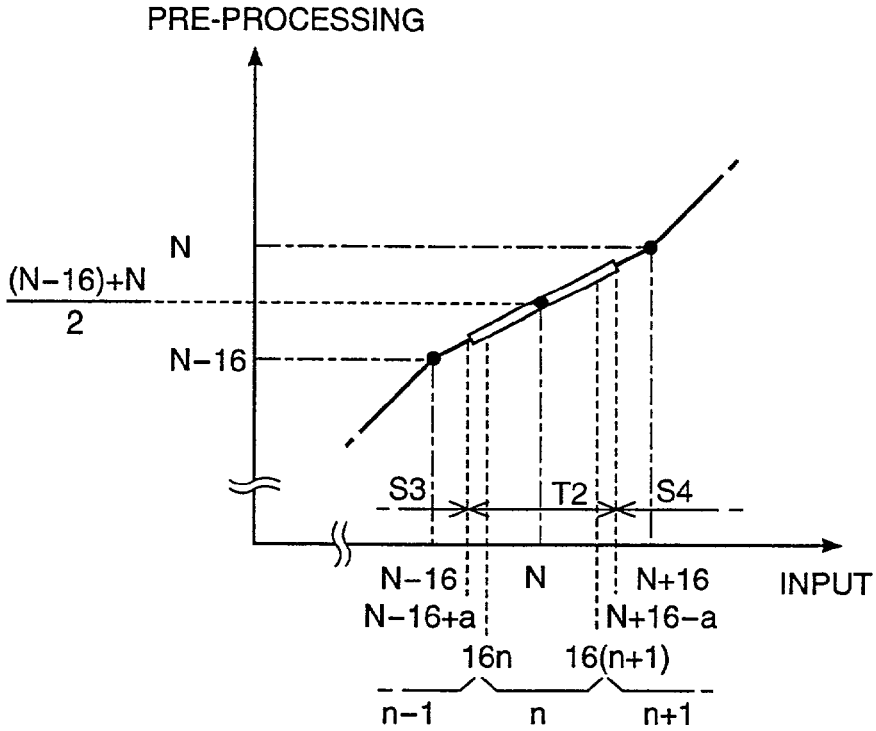
FIG. 27 is a diagram illustrating the conversion content of the pre-processing according to a first applied example of the fourth embodiment.

More specifically, as shown in FIG. 27, it is determined in which range, i.e., a range S3 smaller than the grayscale value [N−16+a], a range T2 from the grayscale value [N−16+a] to smaller than the grayscale value [N+16−a], or a range T4 greater than or equal to the grayscale value [N+16−a], the input data Din(x,y) is contained.

When the input data Din(x,y) falls in the range S3, T2, or S4, the conversion shown in FIG. 29 is applied as the post-processing for the pseudo-halftone processed data. According to this conversion, only when the input value for post-processing (i.e., the pseudo-halftone processed grayscale value) is the grayscale value [n−1] or [n], the output value becomes different. Other than these two values, the input value and the output value are the same.

In this example, when the grayscale value indicated by the input data Din(x,y) ranges from [N−16] to smaller than [N−16+a], and the value to which the dither value has been added becomes [16n] or greater, and when the grayscale value indicated by the input data Din(x,y) ranges from [N+6−a] to smaller than [N+16], and the value to which the dither value has been added becomes smaller than [16(n+1)], that is, only in the above-described two cases, the input data is converted into the grayscale value [n]. Thus, the probability of occurrence of such a conversion is low. Also, the probability of occurrence of the grayscale value [n] is adjustable by the margin [a], as in the applied examples of the second and third embodiments.

Accordingly, in this example, by suitably setting the margin [a], the overall balance of the pseudo-halftone characteristics can be maintained without impairing the display quality.

Figure 28:
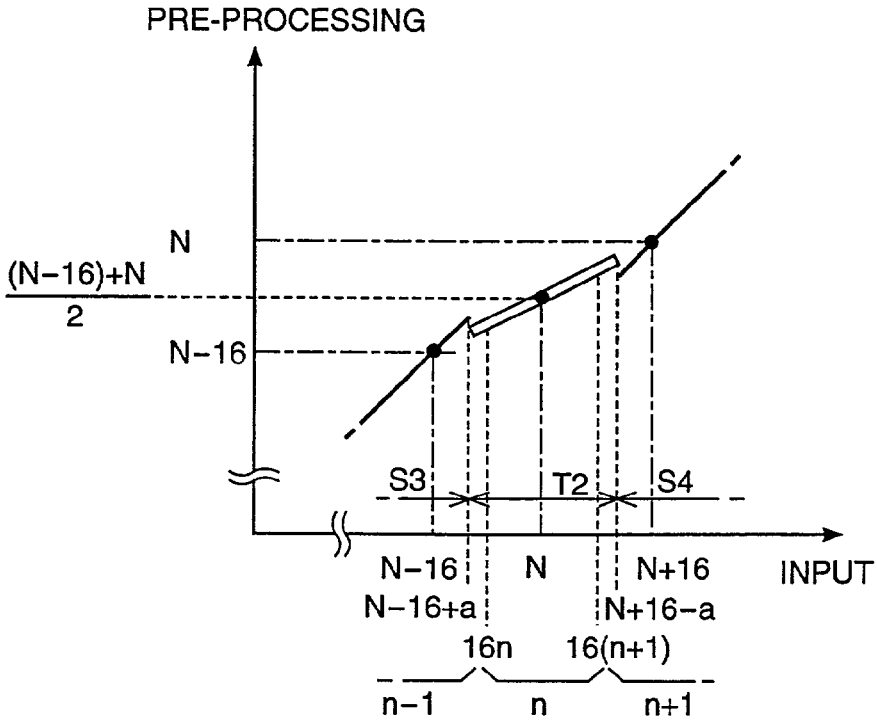
FIG. 28 is a diagram illustrating the conversion content of the pre-processing according to a second applied example of the fourth embodiment.

When the grayscale value indicated by the input data Din(x,y) ranges from 3[N−16] to smaller than [N−16+a] or from [N+16−a] to smaller than [N+16], it is converted into the value with half the inclination by the pre-processing. Then, the pseudo-halftone processing is executed. In this case, the resulting value becomes different from that which has been converted with the inclination characteristic [1] and then subjected to the pseudo-halftone processing. Thus, such a difference may preferably be eliminated by, as shown in FIG. 28, processing the input data corresponding to the above-described two ranges with the inclination [1].

Additionally, although in the above-described fourth embodiment there is only one grayscale value which may cause a defect in the displayed image, the number of such grayscale values may be two or greater.

Figure 30:
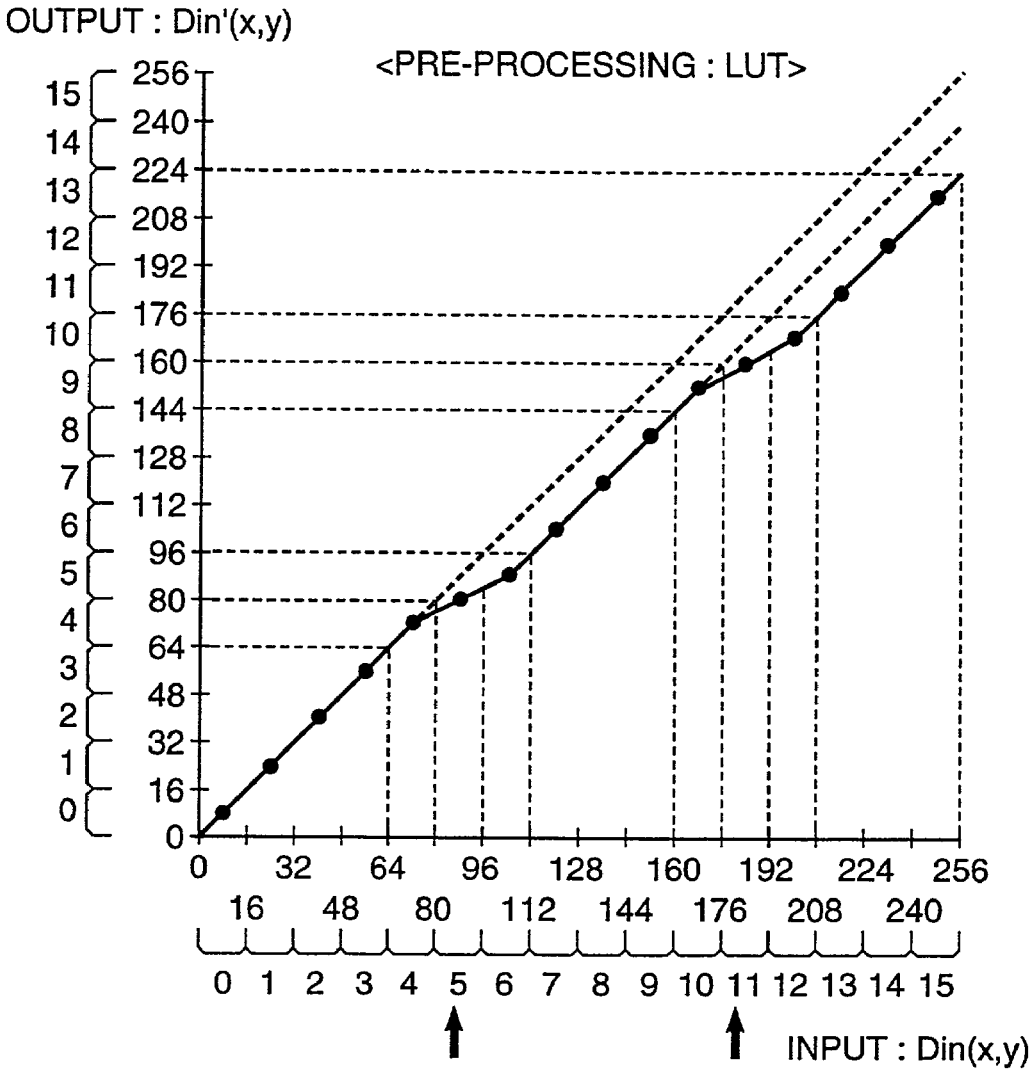
FIG. 30 is a diagram illustrating the conversion content of pre-processing according to a third applied example of the fourth embodiment.

For example, if a defect may be caused in the grayscale value [5] or [11], the pre-processing conversion is indicated by, for example, that shown in FIG. 30. The corresponding post-processing conversion is indicated by, for example, that shown in FIG. 31.

More specifically, the inclination of the conversion characteristics according to the pre-processing shown in FIG. 30 is, in principle, [1]. Exceptionally, the inclination is halved in the range from the center value of the area corresponding to the grayscale value [4] adjacent to the grayscale value [5] to the center value of the area corresponding to the other adjacent grayscale value [6], and also in the range from the center value of the area corresponding to the grayscale value [10] adjacent to the grayscale value [11] to the center value of the area corresponding to the other adjacent grayscale value [12].

The post-processing conversion shown in FIG. 31 is as follows. When the grayscale value of the input data Dout'(x,y) ranges from [0] to [4], it is output as the data Dout(x,y). When the grayscale value of the input data Dout'(x,y) ranges from [5] to [9], it is incremented by [1], and the incremented value is output as the data Dout(x,y). When the grayscale value of the data Dout'(x,y) ranges from [10] to [15], it is incremented by [1], and is further incremented by [1]. The incremented value is then output as the data Dout(x,y).

In the fourth embodiment, the inclination of the pre-processing conversion characteristic is, in principle, a straight line with [1]. However, it may be modified to a curve provided with gamma characteristics. In this case, the inclination of the above-described exceptional cases is halved, and the continuity of the conversion characteristics must be ensured.

From the same point of view, the conversion characteristics (allocation) in the first, second, and third embodiments have also been described as, in principle, a straight line with the inclination [1] passing through the origin. If there are two grayscale values or more which may cause a defect, the same applies to the first, second, and third embodiments.

The first, second, third, and fourth embodiments according to the present invention have been described. However, it is to be understood that the present invention is not restricted to these embodiments, and various applications and modifications may be made within the scope without departing from the spirit of the invention.

In the above-described individual embodiments, the image processing of the present invention is applied to a cellular telephone. However, the present invention is not limited to a cellular telephone. For example, it may be widely applicable to electronic devices provided with color or monochromatic LCD panels for displaying images in grayscales, such as portable information terminals' car navigation systems and the like.

Additionally, the image output apparatus is not restricted to an LCD panel. For example, in an ink-jet printer forming grayscale images by ejecting ink, such as C (cyan), M (magenta), Y (yellow), and Bk (black), a defect may be caused in a specific grayscale value. For example, in an ink-jet printer, the amount of ink ejected is controlled by a combination of the particle size of the ink and the number of ejections. When displaying a certain grayscale, an ink droplet may be formed into an abnormal shape because of, for example, an unsuitable combination, and a defect may be caused in the displayed image.

By applying the image processing of the present invention to this ink-jet printer, the display of the grayscale value which may cause a defect can be prevented, or the probability of occurrence of the grayscale value can be decreased. It is thus possible to prevent the image quality output by this ink-jet printer from being reduced.

Accordingly, as the image output apparatus of the present invention, any type of apparatus which displays or forms images according to grayscale data indicating the pixel grayscales may be used. Thus, it is not essential that the apparatus for executing the image processing and the apparatus for displaying or forming the images are the same, and they may be separate apparatuses.

There may be some cases where color reduction processing has already been performed on the image data downloaded from the server SV so as to be compatible with the image output apparatus, such as an LCD panel. In these cases, the grayscale value [n] which may cause a defect may be converted into the grayscale value [n−1] or [n+1] substantially with 50% probability each.

If the grayscale values which may cause a defect are consecutive, such as [n] and [n+1], the probability of occurrence of the adjacent grayscale values [n−1] and [n+2], respectively, are distributed with the probability according to the original grayscale values.

The apparatus for performing the image processing is not restricted in this invention. For example, the server SV may perform the image processing. More specifically, before downloading the image data from the server SV, the cellular telephone 10 may send data for specifying a grayscale value which may cause a defect to the server SV in advance, and the server SV may execute the image processing of the present invention on the image data to be distributed to the cellular telephone 10. Then, the cellular telephone 10 may download the processed image data. As the data for specifying the grayscale value which may cause a defect, the data indicating such a grayscale value may be used. If the relationships between the machine types of the cellular telephones and the grayscale values are stored in the server SV, the data indicating the machine type may be used.

The apparatus for performing the image processing may be another computer connected to the mobile communication network TN. That is, if the image data is distributed from the computer to the cellular telephone via the server SV, the apparatus for performing the image processing may be such a computer or the server SV.

The invention claimed is:

1. An image processing method, comprising:

inputting data indicating a grayscale of an individual pixel, the input data including a plurality of specific grayscales;

converting said input data into grayscale data which specifies a grayscale of an image output apparatus according to a display capacity of the image output apparatus; and when one of the specific grayscales in said input data of the individual pixel corresponds to a specific grayscale value of the image output apparatus and causes a defect in an output of said image output apparatus, converting at least part of said input data of the individual pixel into grayscale data which specifies a grayscale value other than the specific grayscale value, and supplying the converted grayscale data of the individual pixel to said image output apparatus.

2. An image processing method according to claim 1, said converting further comprising a color reduction processing that reduces the number of levels which is indicatable by said input data into the number of levels which is indicatable by said grayscale data.

3. An image processing method comprising:

inputting data indicating a grayscale of a pixel, the input data including a plurality of specific grayscales;

converting said input data into grayscale data which specifies a grayscale of an image output apparatus according to a display capacity of the image output apparatus; and when one of the specific grayscales in said input data corresponds to a specific grayscale value of the image output apparatus and causes a defect in an output of said image output apparatus, converting at least part of said input data into grayscale data which specifies a grayscale value other than the specific grayscale value, and supplying the converted grayscale data to said image output apparatus;

said converting further comprising a color reduction processing that reduces the number of levels which is indicatable by said input data into the number of levels which is indicatable by said grayscale data;

said color reduction processing being pseudo-halftone processing that distributes said grayscale data so that said grayscale data does not concentrate on the same value.

4. An image processing method comprising:

inputting data indicating a grayscale of a pixel, the input data including a plurality of specific grayscales;

converting said input data into grayscale data which specifies a grayscale of an image output apparatus according to a display capacity of the image output apparatus; and when one of the specific grayscales in said input data corresponds to a specific grayscale value of the image output apparatus and causes a defect in an output of said image output apparatus, converting at least part of said input data into grayscale data which specifies a grayscale value other than the specific grayscale value, and supplying the converted grayscale data to said image output apparatus;

said converting further comprising a color reduction processing that reduces the number of levels which is indicatable by said input data into the number of levels which is indicatable by said grayscale data;

said color reduction processing converting all the input data corresponding to said specific grayscale value into grayscale data which specifies one of grayscale values adjacent to said specific grayscale value.

5. An image processing method, comprising:

inputting data of an individual pixel which indicates a grayscale of an individual pixel, the input data including a plurality of specific grayscales; and converting said input data of the individual pixel into grayscale data which specifies a grayscale of an image output apparatus by reducing the number of levels of said input data of the individual pixel according to a display capacity of the image output apparatus, and by performing pseudo-halftone processing that displays a halftone, in which, when one of the specific grayscales in said input data of the individual pixel corresponds to a specific grayscale value of the image output apparatus and causes a defect in an output of said image output apparatus, at least part of said input data of the individual pixel is converted into grayscale data which specifies one of grayscale values adjacent to said specific grayscale value of the individual pixel, and supplying the converted data of the individual pixel to said image output apparatus.

6. An image processing method comprising:

inputting data which indicates a grayscale of a pixel; and converting said input data of the input pixel into grayscale data which specifies a grayscale of an image output apparatus by reducing the number of levels of said input data according to predetermined characteristics, and by performing pseudo-halftone processing that displays a halftone, in which, when said input data corresponds to a specific grayscale value which causes a defect in an output of said image output apparatus, at least part of said input data is converted into grayscale data which specifies one of grayscale values adjacent to said specific grayscale value, and supplying the converted data of the individual pixel to said image output apparatus;

performing first pseudo-halftone processing on said input data;

determining whether the data subjected to said first pseudo-halftone processing is said specific grayscale value; and outputting the data subjected to said first pseudo-halftone processing as the grayscale data when a result of said determination step is no, and of further performing second pseudo-halftone processing on the data subjected to said first pseudo-halftone processing when a result of said determination step is yes so as to convert the data into the grayscale data which specifies one of the grayscale values adjacent to said specific grayscale value.

7. An image processing method comprising:

inputting data which indicates a grayscale of a pixel; and converting said input data of the input pixel into grayscale data which specifies a grayscale of an image output apparatus by reducing the number of levels of said input data according to predetermined characteristics, and by performing pseudo-halftone processing that displays a halftone, in which, when said input data corresponds to a specific grayscale value which causes a defect in an output of said image output apparatus, at least part of said input data is converted into grayscale data which specifies one of grayscale values adjacent to said specific grayscale value, and supplying the converted data to said image output apparatus;

performing first pseudo-halftone processing on said input data;

determining whether the data subjected to said first pseudo-halftone processing is said specific grayscale value and whether said input data is contained in part of a range corresponding to said specific grayscale value in said characteristics; and outputting the data subjected to said first pseudo-halftone processing as the grayscale data while allowing an output of said specific grayscale value when a result of said determination step is no, and of further performing second pseudo-halftone processing on the data subjected to said first pseudo-halftone processing when a result of said determination step is yes so as to convert the data into the grayscale data which specifies one of the grayscale values adjacent to said specific grayscale value.

8. An image processing method comprising:

inputting data which indicates a grayscale of a pixel; and converting said input data into grayscale data which specifies a grayscale of an image output apparatus by reducing the number of levels of said input data according to predetermined characteristics, and by performing pseudo-halftone processing that displays a halftone, in which, when said input data corresponds to a specific grayscale value which causes a defect in an output of said image output apparatus, at least part of said input data is converted into grayscale data which specifies one of grayscale values adjacent to said specific grayscale value, and supplying the converted data to said image output apparatus;

determining whether said input data is contained in a range which is to be converted into said specific grayscale value after performing first pseudo-halftone processing; and performing said first pseudo-halftone processing on said input data when a result of said determination step is no so as to convert the data into the grayscale data, and of performing second pseudo-halftone processing on said input data when a result of said determination step is yes so as to convert the data into the grayscale data which specifies one of the grayscale values adjacent to said specific grayscale value.

9. An image processing method comprising:

inputting data which indicates a grayscale of a pixel; and converting said input data into grayscale data which specifies a grayscale of an image output apparatus by reducing the number of levels of said input data according to predetermined characteristics, and by performing pseudo-halftone processing that displays a halftone, in which, when said input data corresponds to a specific grayscale value which causes a defect in an output of said image output apparatus, at least part of said input data is converted into grayscale data which specifies one of grayscale values adjacent to said specific grayscale value, and supplying the converted data to said image output apparatus;

determining whether said input data is contained in part of a range which is to be converted into said specific grayscale value after performing first pseudo-halftone processing; and performing said first pseudo-halftone processing on said input data when a result of said determination step is no so as to output the data as the grayscale data while allowing an output of said specific grayscale value, and of performing second pseudo-halftone processing on said input data when a result of said determination step is yes so as to convert the data into the grayscale data which specifies one of the grayscale values adjacent to said specific grayscale value.

10. An image processing method comprising:

inputting data which indicates a grayscale of a pixel; and converting said input data into grayscale data which specifies a grayscale of an image output apparatus by reducing the number of levels of said input data according to predetermined characteristics, and by performing pseudo-halftone processing that displays a halftone, in which, when said input data corresponds to a specific grayscale value which causes a defect in an output of said image output apparatus, at least part of said input data is converted into grayscale data which specifies one of grayscale values adjacent to said specific grayscale value, and supplying the converted data to said image output apparatus;

converting said input data according to modified characteristics in such a manner that one of said characteristics out of a range corresponding to said specific grayscale value remains the same, and an inclination of said range is substantially halved, and the other characteristic out of said range maintains the continuity;

performing pseudo-halftone processing on the data converted by the modified characteristics; and outputting the data, among the data subjected to said pseudo-halftone processing, smaller than said specific grayscale value as the grayscale data, and of shifting each grayscale value of the data greater than or equal to said specific grayscale value.

11. An image processing method, comprising:

inputting data indicating a grayscale of a pixel;

selecting a dither value according to coordinates of said pixel from a predetermined dither matrix for pseudo-halftone processing, and adding the dither value to said input data;

reducing the data obtained by adding the dither value thereto to the number of levels which is indicatable by an image output apparatus;

determining whether the reduced data is a specific grayscale value which causes a defect in an output of said image output apparatus;

outputting the reduced data as is to said image output apparatus when a result of said determination is no; and adding when a result of said determination is yes, said dither value and a value according to said color reduction to the reduced data so as to convert said input data into data which specifies one of grayscale values adjacent to said specific grayscale value according to the addition result and outputting the resulting data to the image output apparatus.

12. An image processing method according to claim 11, the result of said determination being rendered to be yes only when the reduced data is said specific grayscale value, and when the grayscale of said input data is contained in a range corresponding to said specific grayscale value and is contained in a range narrower than the range corresponding to said specific grayscale value.

13. An image processing method, comprising:

inputting data indicating a grayscale of a pixel;

determining whether said input data is contained in a range which is to be converted into a specific grayscale value which causes a defect in an output of an image output apparatus after a dither value is added to said input data, and after the number of levels of said input data is reduced to the number of levels which is indicatable by said image output apparatus;

when a result of said determination is no, adding the dither value to said input data, and the number of levels of said input data is reduced to the number of levels which is indicatable by said image output apparatus, and outputting the resulting data to said image output apparatus; and when a result of said determination is yes, adding a doubled value of said dither value and a value according to said color reduction to said input data so as to convert said input data into data which specifies one of grayscale values adjacent to said specific grayscale value according to the addition result, and outputting the resulting data to said image output apparatus.

14. An image processing method according to claim 13, the result of said determination being rendered to be yes only when said input data is contained in a range narrower than the range which is to be converted into the specific grayscale value which causes a defect in said image output apparatus.

15. An image processing method, comprising:

performing pre-processing on input data indicating a grayscale of a pixel;

performing pseudo-halftone processing on the data subjected to said pre-processing; and performing post-processing on the data subjected to said pseudo-halftone processing, thereby reducing the number of levels of said input data into the number of levels which is indicatable by an image output apparatus;

said image processing method being characterized in that said pre-processing compresses a range from a center value corresponding to one of grayscale values adjacent to a specific grayscale value which causes a defect in an output of said image output apparatus to a center value corresponding to the other adjacent grayscale value into a range from the center value corresponding to one of the grayscale values adjacent to said specific grayscale value to a center value corresponding to said specific grayscale value, and when the data subjected to said pseudo-halftone processing is said specific grayscale value, said post-processing shifts the grayscale value and then outputs the shifted value.

16. An image processing method, comprising:

performing pre-processing on input data indicating a grayscale of a pixel;

performing pseudo-halftone processing on the data subjected to said pre-processing; and performing post-processing on the data subjected to said pseudo-halftone processing, thereby reducing the number of levels of said input data into the number of levels which is indicatable by an image output apparatus;

said image processing method being characterized in that said pre-processing compresses a range from a center value corresponding to one of grayscale values adjacent to a specific grayscale value which causes a defect in an output of said image output apparatus to a center value corresponding to the other adjacent grayscale value into a range from the center value corresponding to one of the grayscale values adjacent to said specific grayscale value to a center value corresponding to said specific grayscale value, and when the grayscale value of said input data is contained in a range including the center value corresponding to said specific grayscale value, and when the data subjected to said pseudo-halftone processing is said specific grayscale value, said post-processing shifts the grayscale value and then outputs the shifted value.

17. An image processing method, comprising:

performing pre-processing on input data indicating a grayscale of a pixel;

performing pseudo-halftone processing on the data subjected to said pre-processing; and performing post-processing on the data subjected to said pseudo-halftone processing, thereby reducing the number of levels of said input data into the number of levels which is indicatable by an image output apparatus;

said image processing method being characterized in that said pre-processing compresses a range including a center value corresponding to a specific grayscale value which causes a defect in an output of said image output apparatus into a range including a mean value of a center value corresponding to one of the grayscale values adjacent to said specific grayscale value and a center value corresponding to said specific grayscale value, and when the grayscale value of said input data is contained in the range including the center value corresponding to said specific grayscale value, and when the data subjected to said pseudo-halftone processing is said specific grayscale value, said post-processing shifts the grayscale value and then outputs the shifted value.

18. An image processing apparatus, comprising:

a conversion circuit that converts input data indicating a grayscale of an individual pixel into grayscale data which specifies a grayscale of an image output apparatus according to a display capacity of the image output apparatus, the input data including a plurality of specific grayscales, wherein, when one of the specific grayscales in said input data of the individual pixel corresponds to a specific grayscale value of the image output apparatus and causes a defect in an output of said image output apparatus, said conversion circuit converts at least part of said input data of the individual pixel into grayscale data which specifies a grayscale value other than the specific grayscale value, and supplies the converted grayscale data of the individual pixel to said image output apparatus.

19. An image processing apparatus, comprising:

a conversion circuit that converts input data indicating a grayscale of an individual pixel into grayscale data which specifies a grayscale of an image output apparatus by reducing the number of levels of said input data according to a display capacity of the image output apparatus, and by performing pseudo-halftone processing for displaying a halftone, the input data including a plurality of specific grayscales, wherein, when one of the specific grayscales in said input data of the individual pixel corresponds to a specific grayscale value of the image output apparatus and causes a defect in an output of said image output apparatus, said conversion circuit converts at least part of the data of the individual pixel into grayscale data which specifies one of grayscale values adjacent to said specific grayscale value, and supplies the converted data of the individual pixel to said image output apparatus.

20. An electronic device, comprising:

an image processing apparatus and an image output apparatus, said image processing apparatus converting input data indicating a grayscale of an individual pixel into grayscale data which specifies a grayscale of said image output apparatus by reducing the number of levels of said input data according to a display capacity of the image output apparatus and by performing pseudo-halftone processing for displaying a halftone, the input data including a plurality of specific grayscales;

said image processing apparatus comprising a conversion circuit that, when one of the specific grayscales in said input data of the individual pixel corresponds to a specific grayscale value and causes a defect in an output of said image output apparatus, converts at least part of the input data of the individual pixel into the grayscale data which specifies one of grayscale values adjacent to said specific grayscale value, and said image forming apparatus outputting an image according to the grayscale data of the individual pixel converted by said image processing apparatus.

21. An image processing program which causes a computer that supplies grayscale data which specifies a grayscale of an image output apparatus to said image output apparatus to function as device that indicates a grayscale of an individual pixel into said grayscale data by reducing the number of levels of the input data according to a display capacity of the image output apparatus and by performing pseudo-halftone processing for displaying a halftone, the input data including a plurality of specific grayscales, wherein when one of the specific grayscales in said input data of the individual pixel corresponds to a specific grayscale value and causes a defect in an output of said image output apparatus, the device converts at least part of the data of the individual pixel into the grayscale data which specifies one of grayscale values adjacent to said specific grayscale value, and supplies the converted grayscale data of the individual pixel to said image output apparatus.

22. A computer-readable recording medium on which an image processing program is recorded, said image processing program causing a computer for supplying grayscale data which specifies a grayscale of an image output apparatus to said image output apparatus to function as device that indicates a grayscale of an individual pixel into said grayscale data by reducing the number of levels of the input data according to a display capacity of the image output apparatus and by performing pseudo-halftone processing for displaying a halftone, the input data including a plurality of specific grayscales, wherein when one of the specific grayscales in said input data of the individual pixel corresponds to a specific grayscale value which causes a defect in an output of said image output apparatus, the device converts at least part of the data of the individual pixel into the grayscale data which specifies one of grayscale values adjacent to said specific grayscale value, and supplies the converted grayscale data of the individual pixel to said image output apparatus.

* * * * *